United States Patent [19]

Fujita

[11] 4,084,679

[45] Apr. 18, 1978

[54] TAPE PRINTER

[75] Inventor: Mituo Fujita, Sakatomachi, Japan

[73] Assignee: Kabushiki Kaisha Shinsei Industries, Tokyo, Japan

[21] Appl. No.: 715,638

[22] Filed: Aug. 18, 1976

[30] Foreign Application Priority Data

| | | |
|---|---|---|
| Aug. 18, 1975 | Japan | 50-100010 |
| Feb. 5, 1976 | Japan | 51-11484[U] |
| May 1, 1976 | Japan | 51-50353 |
| May 21, 1976 | Japan | 51-57962 |

[51] Int. Cl.[2] ..... B41J 1/30

[52] U.S. Cl. ..... 197/6.7; 197/53; 197/151

[58] Field of Search ..... 197/6.2–6.7, 197/16, 18, 49, 58, 53, 151, 172; 101/18, 19, 398

[56] References Cited

U.S. PATENT DOCUMENTS

| | | | |
|---|---|---|---|
| 3,272,301 | 9/1966 | Craig | 197/6.7 |
| 3,381,789 | 5/1968 | Hawes | 197/49 X |
| 3,640,369 | 2/1972 | Rolph | 197/54 |
| 3,912,064 | 10/1975 | Bluem et al. | 197/6.7 |
| 3,926,110 | 12/1975 | Hubbard et al. | 101/92 |

*Primary Examiner*—Ralph T. Rader
*Attorney, Agent, or Firm*—Armstrong, Nikaido, Marmelstein & Kubovcik

[57] ABSTRACT

A tape printer adapted so that a tape which employs a paper tape for printing is extended to a printing position, a type of a type wheel is opposed to a tape leading part at said printing position, said type and tape leading part are impressed to print the type onto the paper tape, said type wheel is provided with types arranged on its periphery in sequence in a circumferential direction of the type wheel and the type wheel is rotated to move a desired type to the printing position.

16 Claims, 52 Drawing Figures

12
10
13
83
84
81
72
70
71
11
30
31
85
80
73'
20
731'
522
84
132
82'
14
62
131
53
63
20'
51
40
41
43
42
60
541
54
52'
50
52
90
20''

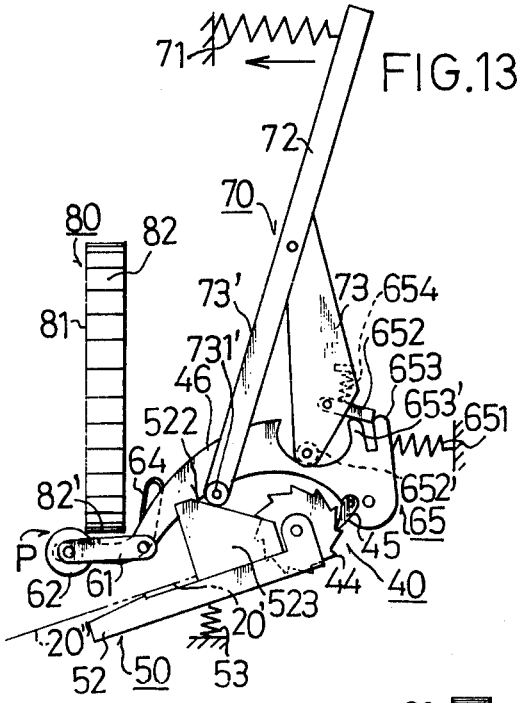
FIG.13A
FIG.13B
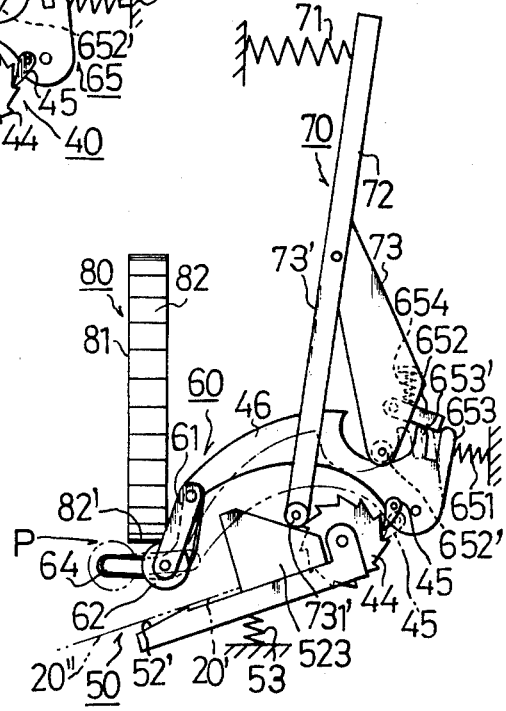

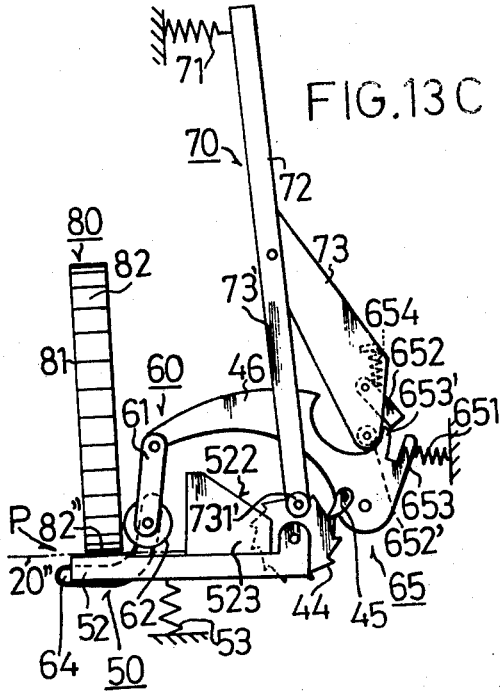
FIG.13C
FIG.13D
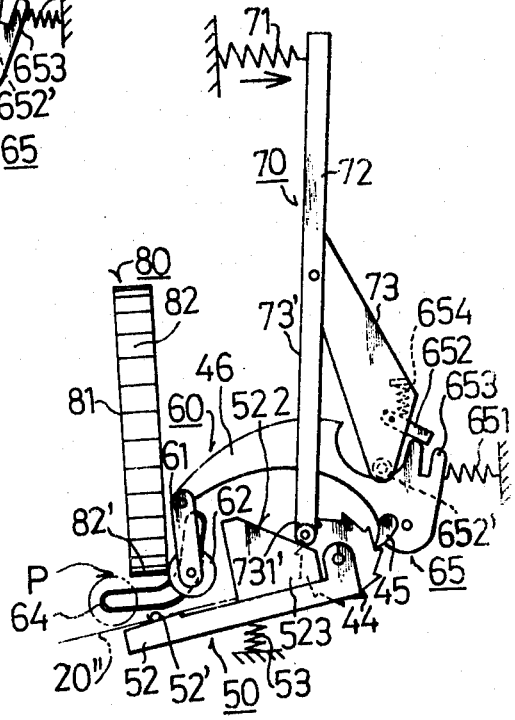

FIG. 24
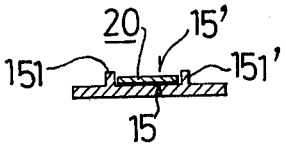
FIG. 25
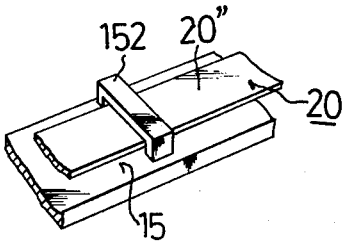
FIG. 26
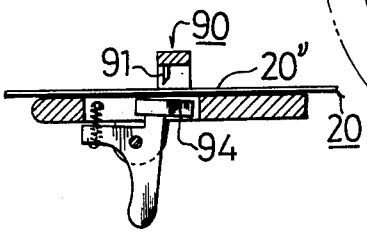
FIG. 30 A
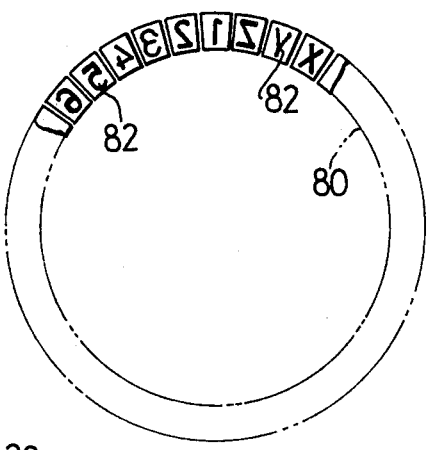
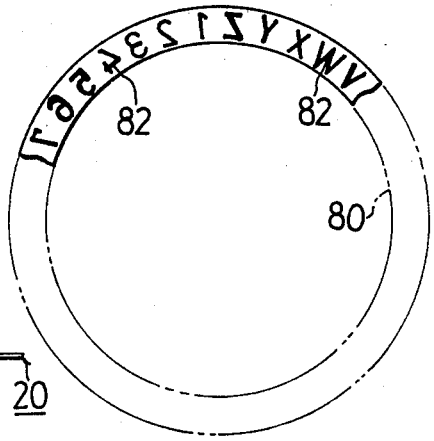
FIG. 30B FIG.28
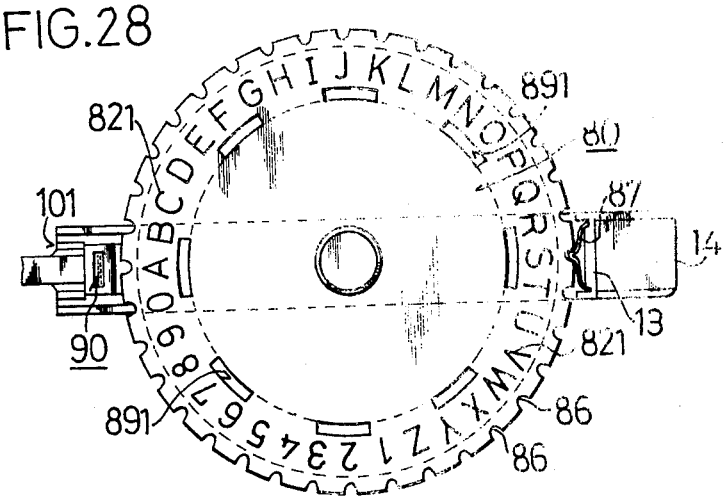
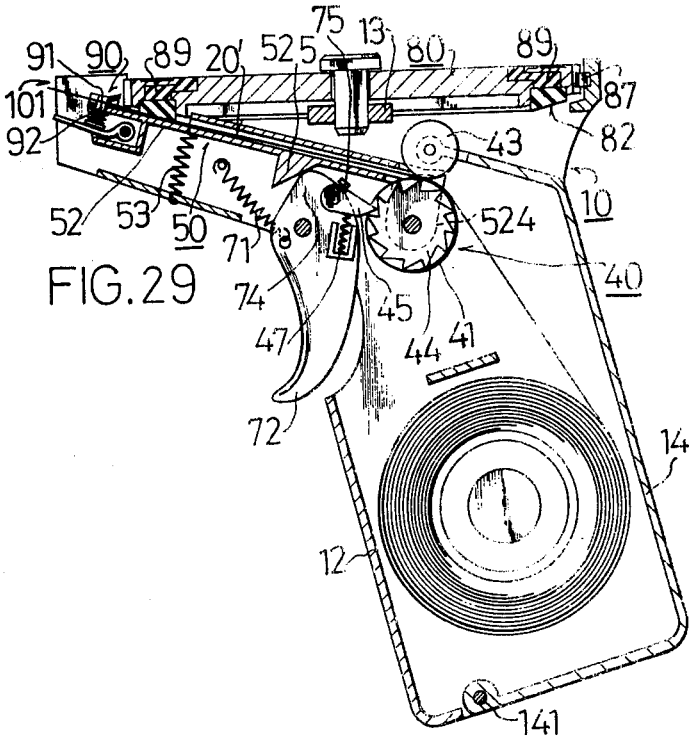
FIG.29

FIG.31
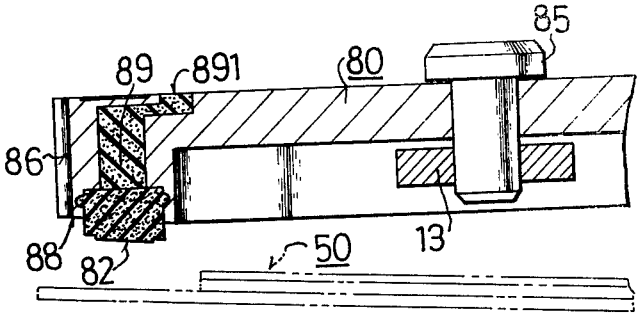
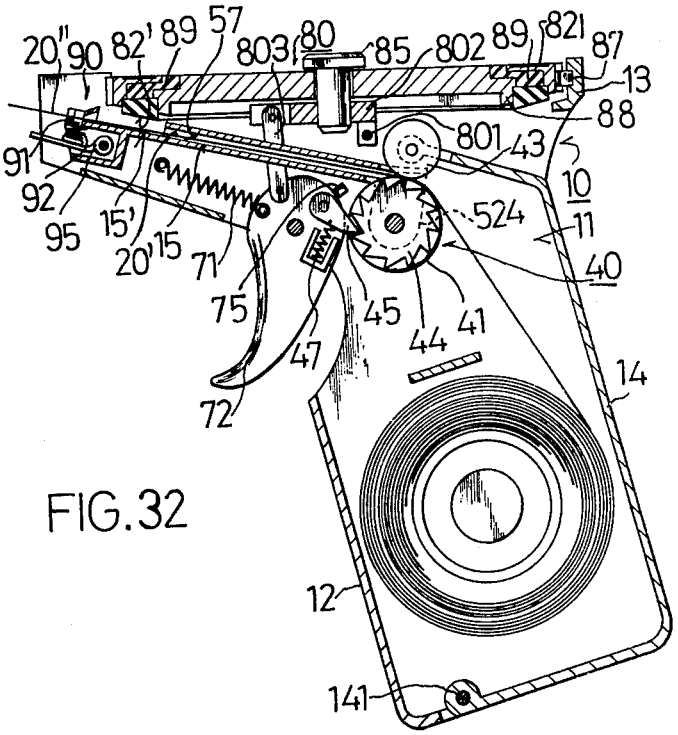
FIG.32

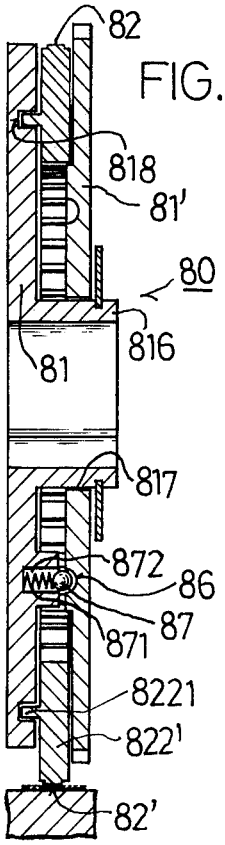
FIG.40
FIG.41
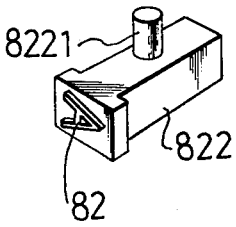

TAPE PRINTER

BACKGROUND OF THE INVENTION

The present invention relates to the manually-operated tape printing apparatus.

Conventionally manually-operated marking presses have been used as this type of apparatus specified in the U.S. Pat. Nos. 3,263,790 and 3,263,791. Since the marking press is designed to depress the types onto a plastic tape, it is disadvantageous in that the cost of tape is expensive and a considerable strength of power is required for marking and therefore easy use of the marking press is difficult.

The first object of the present invention is to provide a tape printing apparatus using an inexpensive paper tape to reduce the cost of the tape.

Another object of the present invention is to provide a tape printing apparatus capable of performing a desired printing without a large force by impressing the types to which an ink is applied onto the paper tape.

A further another object of the present invention is to provide a tape printing apparatus capable of accurately controlling the position of the tape to be printed by the guide means provided at the tape extending part.

SUMMARY

The present invention provides a tape printer comprising a tape which employs a paper tape for printing and is stored in the form of roll in the tape storing section, a tape extending part which has a tape extending surface, such as, for example, a tape receiving surface or a surface of a moving frame which extends the tape and is provided with a guide means such as, for example, a pair of guide slots which store both edges of the tape or a tunnel type frame through which the tape is passed; a type wheel which is designed so that the periphery, for example, one point of the external periphery or the peripheral surface is opposed to the surface of paper tape of said tape extending part; types for printing are arranged in sequence in the circumferential direction on the periphery including the printing position and the type at the printing position opposed to the paper tape of the tape extending part can be selected by rotating the type wheel in the circumferential direction; tape impression means which alternatively impresses the type of the type wheel at the printing position and the paper tape opposed to the type such as, for example, an actuating means which impresses the moving frame or the type wheel onto the tape; an ink supplying means which supplies the ink to the surface of at least one type at the printing position such as, for example, an ink applying means provided with an ink roller or an ink exuding means for which the ink impregnated part is provided on the type wheel; a tape feeding means which feeds the tape to supply a new paper tape blank on said tape extending part after printing; and an operating means which operates said tape feeding means and said tape impression means in sequence such as, for example, a movable lever, wherein such advantages are obtained as the cost of the tape can be remarkably reduced by using the paper tape, a large force is not required due to the printing by means of the types and misalignment does not take place in printing since the tape is secured by the guide means during impression.

BRIEF DESCRIPTION OF THE DRAWINGS

The tape printer in accordance with the present invention is illustrated in detail in the accompanying drawings whereof;

FIGS. 13A and 13D are a sketch illustrating in steps the opertions of the tape printer shown in the first embodiment, FIG. 24 is an end face view along line 24—24 in FIG. 23, FIG. 25 is a perspective view illustrating an embodiment of the tape guide means in the second embodiment, FIG. 26 is a longitudinal side view illustrating the tape cutting mechanism, FIG. 28 is a plan view of the above, FIG. 29 is a longitudinal side view illustrating the operating condition of the tape printer shown in FIG. 28, FIGS. 30A and 30B are a plan view illustrating the types provided on the type wheel of said tape printer, FIG. 31 is a longitudinal side view of a part of the type wheel of said tape printer, FIG. 32 is a longitudinal side view of the tape printer with a movable type wheel of the third embodiment, FIG. 40 is a cross sectional view along line 40—40 in FIG. 39, FIG. 41 is a perspective view of the type of the type wheel shown in FIG. 40.

DETAILED DESCRIPTION OF THE INVENTION

Figure 1:
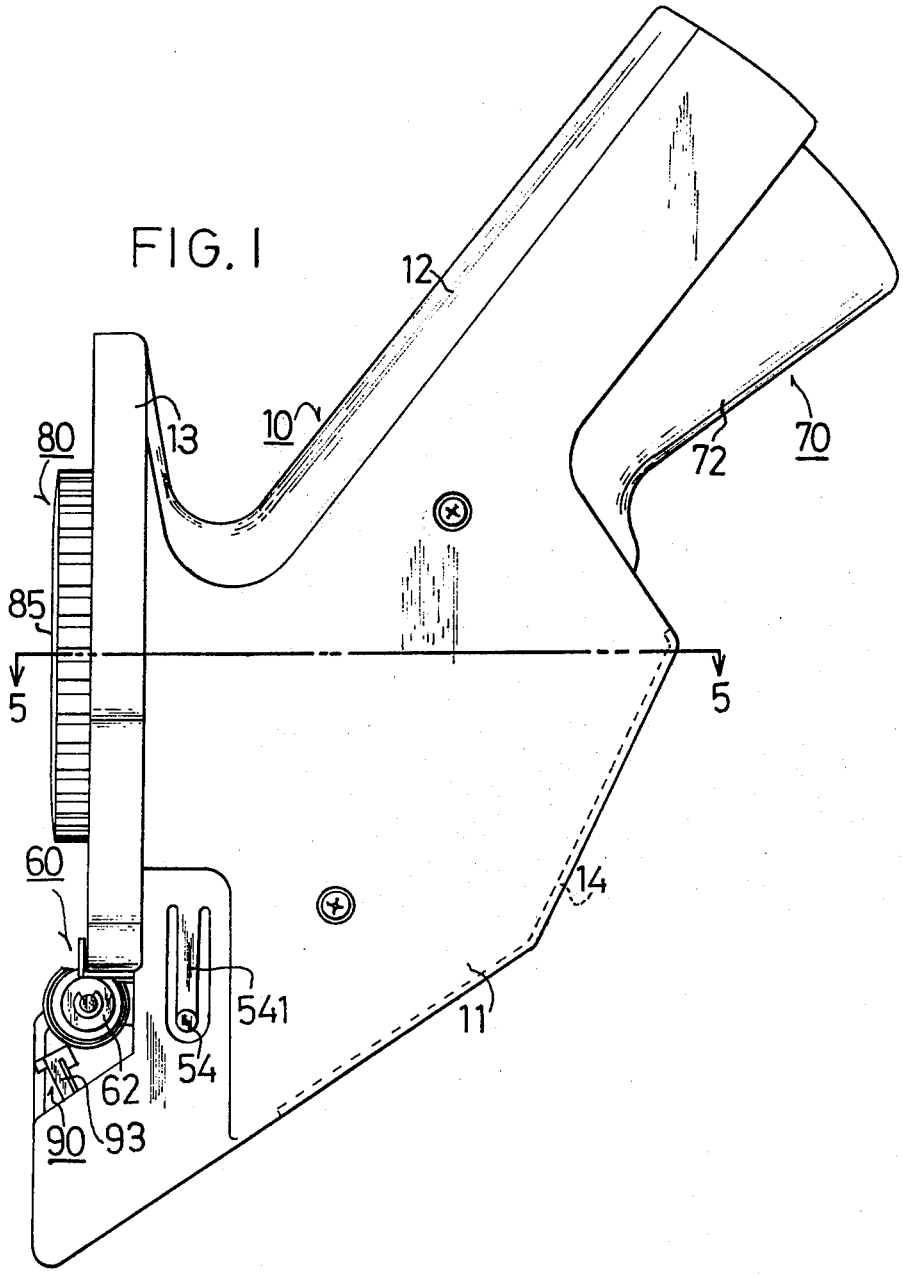
FIG. 1 is a side view illustrating the first embodiment of the tape printer of the present invention.
Figure 2:
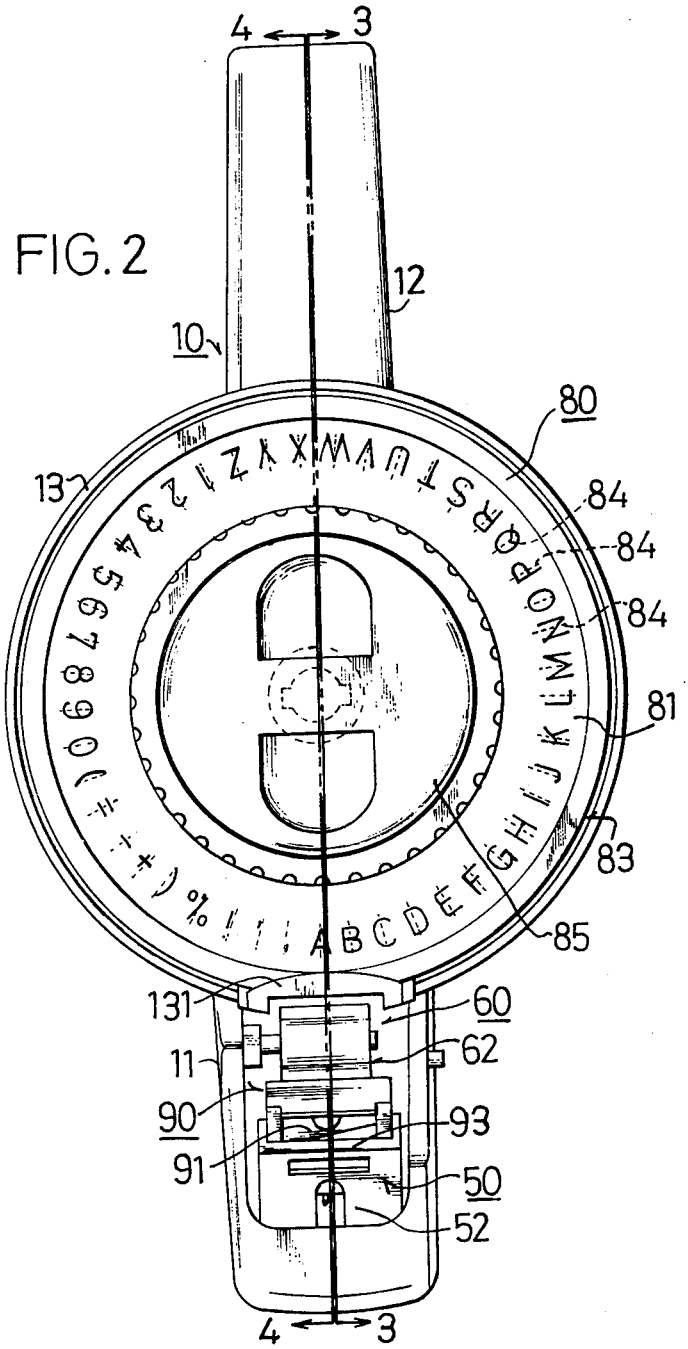
FIG. 2 is a front view of the above.
Figure 3:
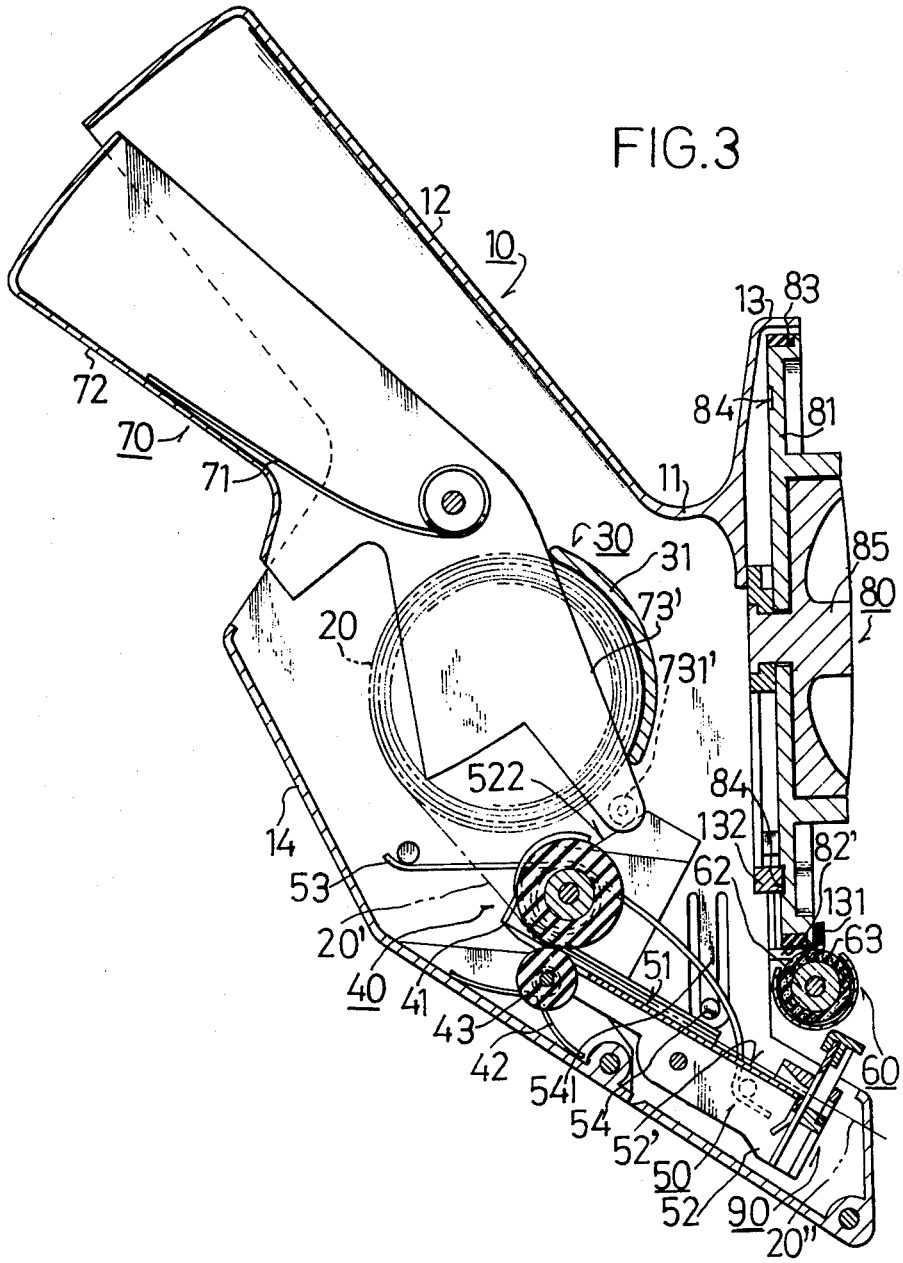
FIG. 3 is a cross sectional view along line 3—3 in FIG. 2.
Figure 4:
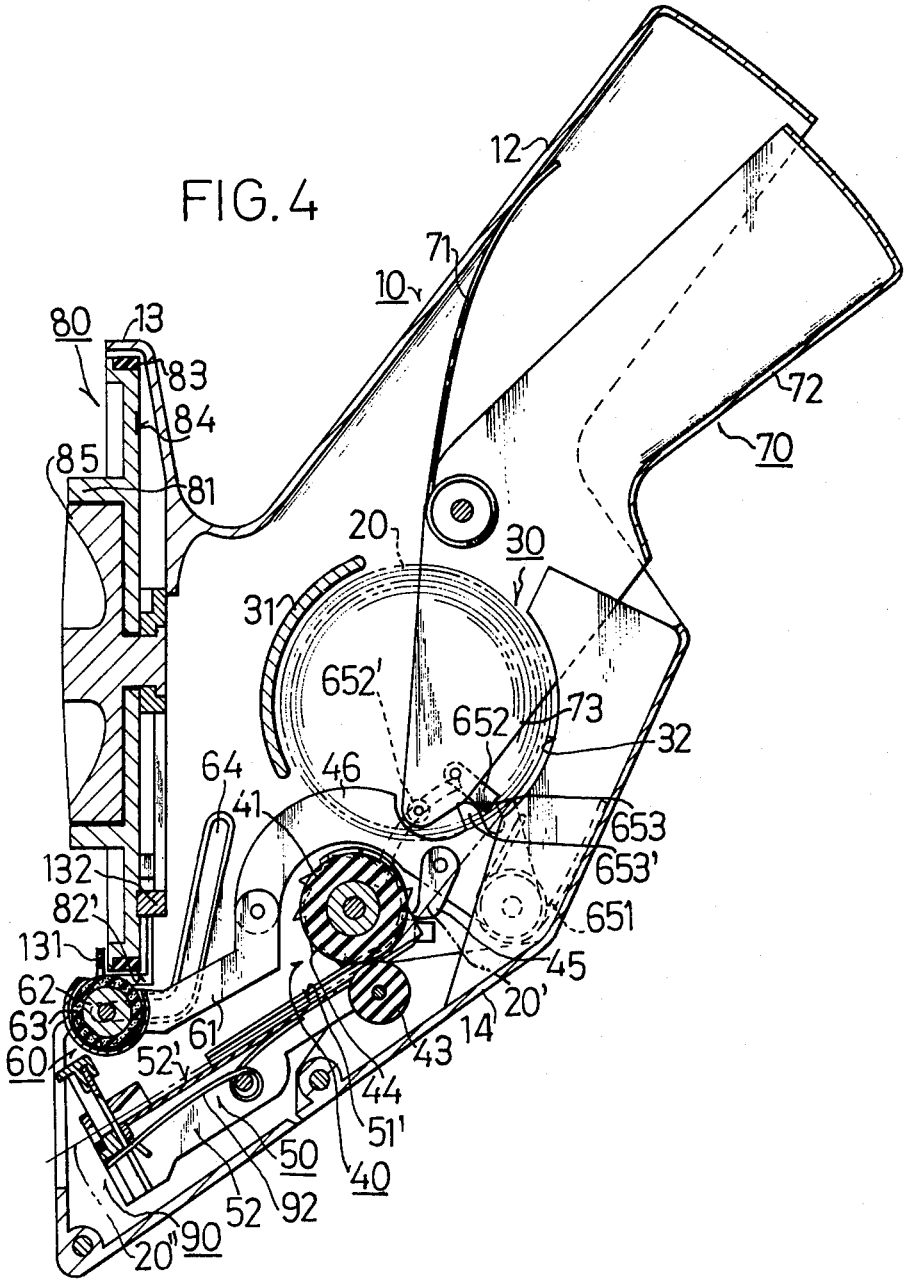
FIG. 4 is a cross sectional view along line 4—4 in FIG. 2.
Figure 5:
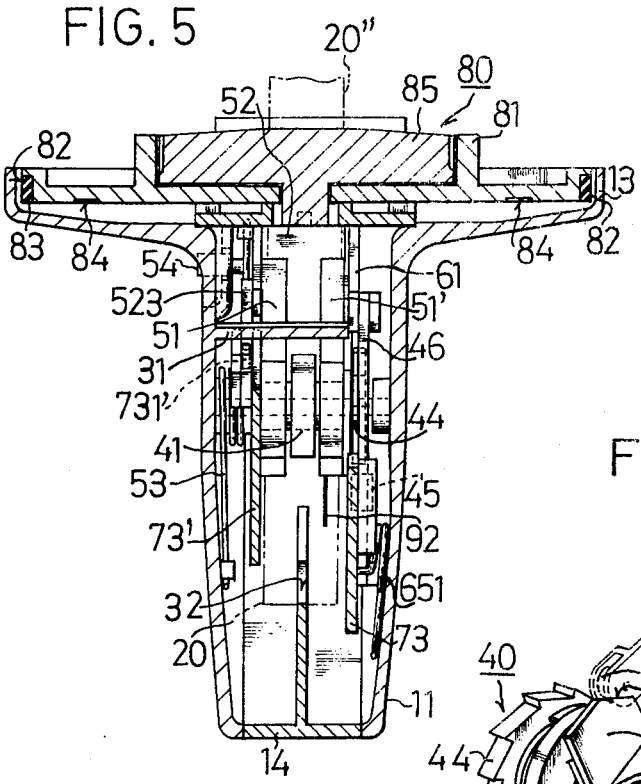
FIG. 5 is a cross sectional view along line 5—5 in FIG. 1.

Referring to FIGS. 1 to 15, case 10 shown in this embodiment comprises main body 11 which has internally a chamber, handle 12 extended from this main body 11, type wheel holding part 13 which is slantly provided in reference to handle 12 and covering plate 14 which is pivotally mounted to be openable on the main body to close the opening provided on a part of main body.

The internal chamber of main body 11 incorporates tape holder 30 which holds tape 20, tape feeding means 40, tape impression means 50 and ink applying means 60 as the ink supplying means, and manual operating member 70 is provided opposite to handle 12 and disk-shaped type wheel 80 is mounted on type wheel holder 13.

Figure 7:
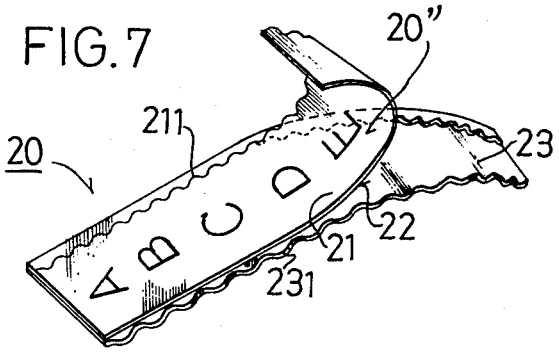
FIG. 7 is a perspective view illustrating a printed part of the tape.

Operating means 70 is always kept at the specified position by the resetting means. It is adapted to actuate tape impression means 50 and ink applying means 60 by an operation against the force of the resetting means (hereinafter referred to as the actuating operation) while tape feeding means 40 is actuated by the resetting operation; for example, the turning ends of lever 72, which is pivotally mounted in main body 11 and kept at the given position by spring 71 as the resetting means are formed into a pair of extended parts 73 and 73' within main body 11 and one extended part 73 actuates ink applying means 60 and tape feeding means 40 while the other extended part 73' actuates tape impression means 50. Though said tape 20 can be made of a sheet of paper, it comprises, as shown in FIG. 7, paper tape 21, adhesive layer 22 which is made by applying an adhesive agent to the rear surface of paper tape 21 and cover tape 23 made of a suitable kind of material which can easily be peeled off from adhesive layer 22 and is adhered to adhesive layer 22. Tape 20 is wound in the form of roll and stored in tape storing part 30. It is preferable to provide cover tape 23 with, for example, projections 231 for easy pick up by a finger to ensure easy separation of cover tape 23 from paper tape 21 and/or to give notched line 211 in paper tape 21.

Figure 8:
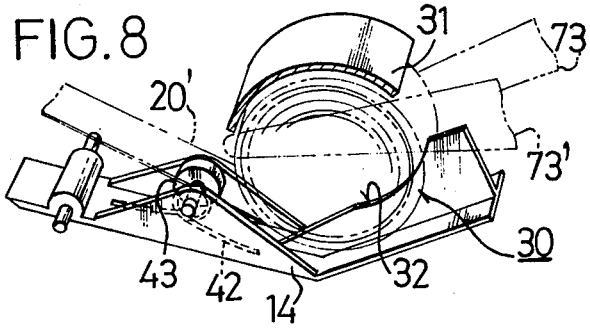
FIG. 8 is a perspective view illustrating the tape storing section.

As shown in FIG. 8, tape storing part 30 is constructed so that circular piece 31 which is provided to be across the internal chamber in main body 11 of case 10 is made a receiving surface at the fixing side and circular surface 32 which is provided on the internal surface of cover plate 14 opposite to circular piece 31 is made a receiving surface at the moving side. Tape 20 is inserted in main body 11 by opening cover plate 14 and cover plate 14 is closed after insertion of the tape, thereby tape 20 is rotatably supported between circular piece 31 and circular surface 32.

Through tape 20 can be supported at its side by a resilient piece extended from circular surface 32, it is preferable to support tape 20 by extended parts 73 and 73' of operating member 70 while tape 20 can rotate between extended parts 73 and 73' as shown with a two-dotted broken line in FIG. 8.

Figure 9A:
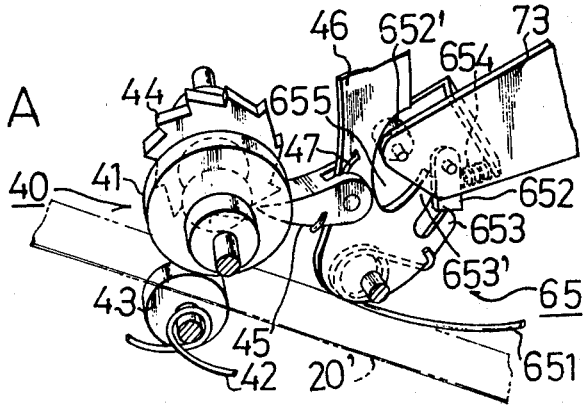
FIG. 9A is a perspective view illustrating an embodiment of the tape feeding means.

Tape feeding means 40 comprises, as shown in FIG. 9A, feed roller 41 provided at the tape feeding side of tape storing part 30, impression roller 43 which is provided inside covering plate 14 and is impressed onto feed roller 41 by spring 42, ratchet wheel 44 provided coaxially with feed roller 41 and feed claw 45 which engaged with ratchet wheel 44, whereby ratchet wheel 44 is rotated to the specified angle by feed claw 45 during the resetting operation.

In this embodiment, therefore, swing lever 46 is provided which is pivotally secured at its one end to the internal wall of main body 11 and engaged with its body to extended part 73 of lever 72 in order to separate from ratchet wheel 44 during the actuating operation of lever 72 and approach ratchet wheel 44 during the resetting operation of lever 72, and this lever 46 is provided with feed claw 45 so that feed claw 45 is disengaged from ratchet wheel 44 to move in a direction opposite to the rotating direction of the ratchet wheel during the actuating operation of lever 72 and is engaged with ratchet wheel 44 to rotate ratchet wheel 44 to a specified angle. Feed claw 45 is provided with spring 47 which energizes feed claw 45 upwardly in FIG. 9A to ensure sequential engagment of feed claw 45 with ratchet wheel 44 and guide 49 which controls movement of feed claw 45 and the engaging position of feed claw 45 with ratchet wheel 44.

Figure 10:
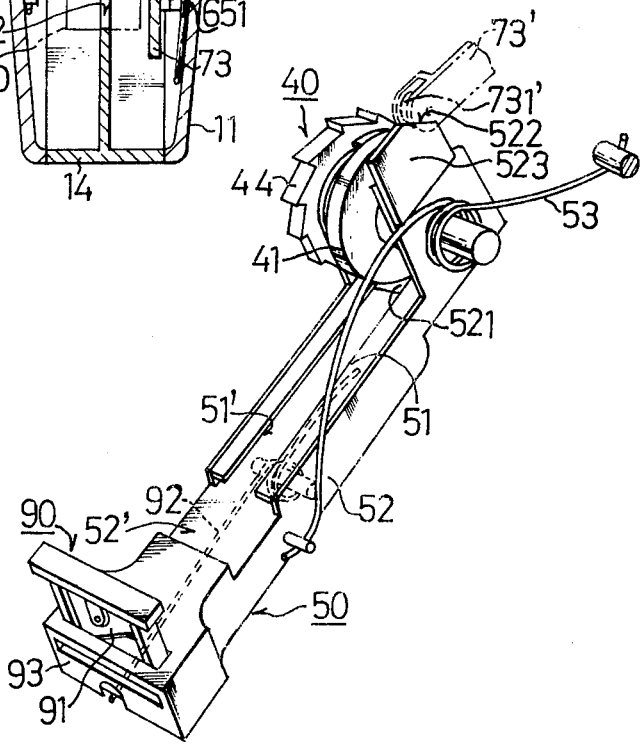
FIG. 10 is a perspective view illustrating an embodiment of the tape impression means.
Figure 6:
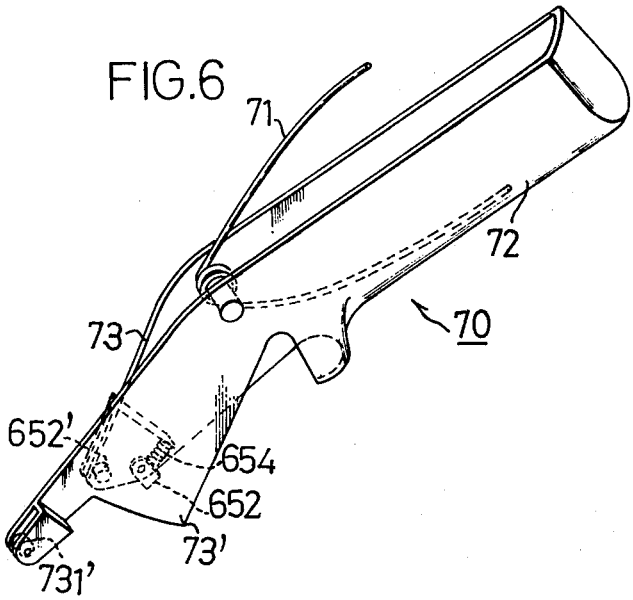
FIG. 6 is a perspective view of the operating lever of said tape printer.

Tape impression means serves to relatively impress tape leading part 20' and a type of type wheel 80 and comprises as shown in Fig. 10, a guide means which guides tape 20 drawn out from tape storing part 30 to the surface of frame 52 serving as the tape extending part and holds paper tape 21 of leading part 20' of tape 20 to oppose to a point of the periphery of type wheel 80, that is, to printing position P such as, for example, guide slots 51 and 51' into which both side edges of leading part 20' of the tape are inserted, moving frame 52 provided with these guide slots 51 and 51' and tape impressing part 52' of said tape extending part and impression spring 53 which always deflects the frame 52 to type wheel 80 to impress paper tape 21 of leading part 20' located on tape impressing part 52' onto type wheel 80. The base of frame 52 is secured pivotally coaxially with feed roller 41 so that leading part 20' of the tape led from between feed roller 41 and impression roller 43 of tape feeding means 40 may be immediately inserted into guide slots 51 and 51' and notch 521 is formed at the center of the base and feed roller 41 is inserted into notch 521.

Frame 52 contacts extended part 73' of lever 72 by which frame 52 is separated from type wheel 80 against impression spring 53 when lever 72 stays at the home position and released from extended part 73' when lever 72 is in the actuating operation so that frame 52 contacts under pressure type wheel 80.

For this, the base of frame 52 is provided with contact piece 523 having cam edge 522 with which roller 731' provided at extended part 73' of lever 72 contacts.

Figure 11:
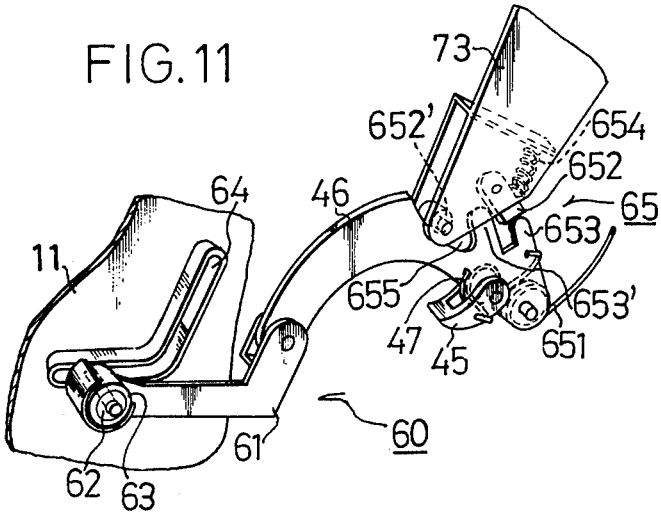
FIG. 11 is a perspective view illustrating an emmbodiment of the ink applying means.

Ink applying means 60 comprises, as shown in FIG. 11, coupling member 61 connected to lever 46, ink roller 62 which is provided at the extreme end of support member 61, arranged at a position nearer the type wheel than frame 52 and provided with pad 63 which is impregnated with ink and guide means which guides sliding member 61 such as, for example, guide slot 64 provided in main body 11 wherein support member 61 is adapted to be guided by guide slot 64 to cause in roller 62 to retreat into main body 11 in precedence of approach of frame 52 forming tape impression means 50 and ink roller 62, that is, ink pad 63 to contact an opposing type of type wheel 80, that is, a type at printing position P when the ink roller retreats during the actuating operation of lever 72.

Ink roller 62 is preferably adapted to contact at least two times a type at the printing position P during the actuating operation of lever 72 and therefore inking repeating means 65 is provided.

In FIG. 11, inking repeating means 65 comprises resetting spring 651 which always impresses lever 46 to cause ink roller 62 to be secured at a position outside the type wheel 80, that is, the starting position, two engaging parts 652 and 652' provided at one of lever 46 and extended part 73 of lever 72, for example, extended part 73 of lever 72 and two receiving parts 653 and 653' provided on lever 46 so as to be engaged by engaging parts 652, and 652' wherein first engaging part 652 initially engages with first receiving part 653 to cause ink roller 62 to contact type wheel 80, engaging part 652 disengages from receiving part 653 to cause ink roller 62 to be reset to the start position by resetting spring 651 and second engaging part 652' engages with second receiving part 653' to cause ink roller 62 to contact again the type wheel 80 during the actuating operation of lever 72.

For this, first engaging part 652 is made of a movable piece energized by spring 654 and engaging part 652 can be reset by spring 654 without being engaged with receiving part 653 when extended part 73 is reset. Space 655 is provided at the adjacent part of second receiving part 653' so that ink roller 62 can be reset to the start position after disengagement of first engaging part 652 and the timing for engagement of second engaging part 652' and second receiving part 653' is determined in accordance with the length of space 655.

Since ink roller 62 is reset once during the actuating operation of lever 72, it is necessary to determine the time lag which permits the resetting of ink roller 62 in accordance with the length of space 655 along the moving direction of lever 46.

A point to be considered in this embodiment is that lever 46 causes feed claw 45 to temporarily move in the feeding direction of ratchet wheel 44 by the intermediate resetting operation of ink roller 62 in spite that lever 72 is in the actuating operation.

Figure 9B:
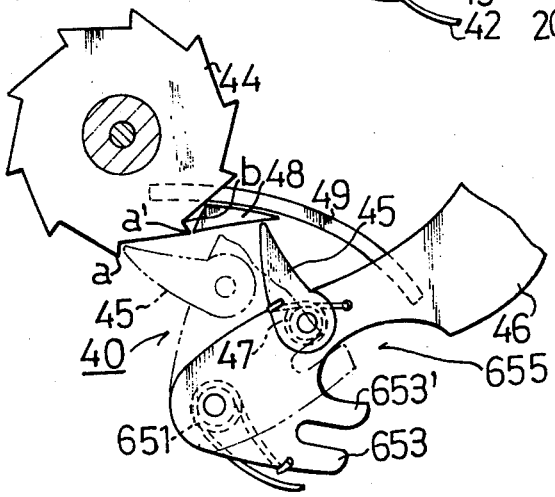
FIG. 9B is a side view illustrating the tape stopping mechanism of the tape feeding means.

Accordingly, it is necessary to control movement of lever 46 performed by first engaging part 652 so that such movement is possible only in the range where feed claw 45 coupled to lever 46 does not come off from the same tooth of ratchet wheel 44, that is, in the range of *a* – *a'* shown in FIG. 9B in order to prevent feed claw 45 from rotating ratchet wheel 44 during the above operation.

Figure 14:
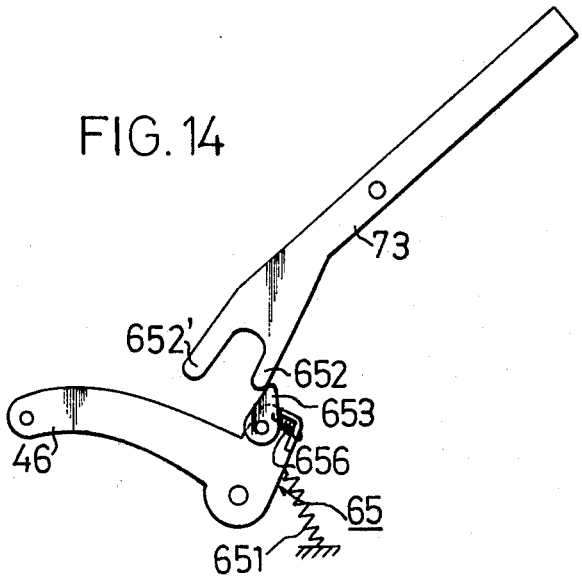
FIGS. 14 and 15 are a side view illustrating another embodiment of the inking repeating means shown in said first embodiment.

Inking repeating means 65 shown in FIG. 14 is provided with two engaging parts 652 and 652' at the side of extended part 73 and one reciving part 653 at the side of lever 46 and receiving part 653 is made of the movable piece tensioned by spring 656 to permit resetting of first engaging part 652.

Figure 15:
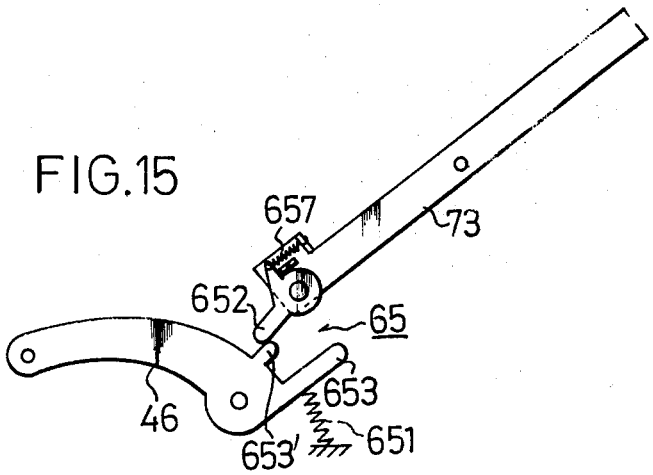

Inking repeating means 65 shown in FIG. 15 is provided with one engaging part 652 at the side of extended part 73 and two receiving parts 653 and 653' at the side of lever 46 and engaging part 652 is provided with spring 657 so that engaging part 652 contacts receiving part 653' and can retreat in resetting.

As known from the above description, as inking repeating means 65, at least two-stage engaging parts (or receiving parts) can be provided at one of extended part 73 and lever 46 and at least one receiving part (or engaging part) at the remaining part and the construction of the inking repeating means can be selected as desired.

Frame 52 and ink roller 62 are set so that ink roller 62 retreats initially from between type wheel 80 and frame 52 during the actuating operation of lever 72 and frame 52 comes in contact with type wheel 80 while frame 52 is initially released and retreated from type wheel 80 and ink roller 62 is reset.

For this, cam edge 522 of frame 52 can be adapted so that frame 52 does not operate while rotor 731' of extended part 73' of lever 72 is kept contacted with cam edge 522 during the actuating operation of lever 72 and rotor 731' contacts the cam edge 522 to cause frame 52 to early operate in precedence of resetting of ink roller 62 during the resetting operation of lever 72.

Figure 12:
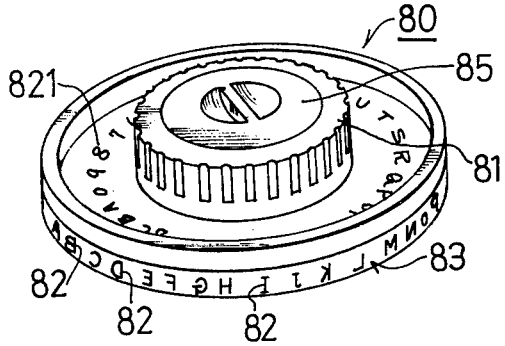
FIG. 12 is a perspective view illustrating the type wheel.

Type wheel 80 has, as shown in FIG. 12, disk type base 81 and a number of types provided on the periphery of this base.

Types 82 can be directly provided on base 81. On the other hand, type strip 83 on which a number of types 82 are provided in sequence in the peripheral direction can be closely attached to the periphery of base 81 and thus replacement of type strip 83 is advantageous in extension of the service life. Type wheel 80 is marked with read characters 821 corresponding to the types and notch 84 is provided for each type on the rear surface of type wheel 80.

Type wheel holding part 13 is provided with a fastening means which fastens type wheel 80 to prevent type wheel 80 from coming off from type wheel holding part 13 such as, for example, resilient depressing piece 131 which depresses type wheel 80 at its one point onto type wheel holding part 13 in the direction of thickness of type wheel 80, and projection 132 which meshes with notch 84 of type wheel 80 is provided on the bottom surface of the type wheel holding part opposing to resilient depressing means 131. Moreover, type wheel 80 is provided with fastener 85 which fastens concentrically and remountably the type wheel on type wheel holding part 13. Cutting mechanism 90 is provided at the extreme end of frame 52 as shown in FIG. 10.

Cutting mechanism 90 comprises cutting edge 91 which is provided so as to intersect orthogonally the passage for tape leading part 20' and spring 92 which always keeps this cutting edge 91 away from the passage and preferably includes frame 93 which is fixed on frame 52 so that said cutting edge 91 can slide inside frame 93.

Tape impression means 50 is preferably provided with a frame stopping means, which stops movement of frame 52 as required so that frame 52 does not move toward type wheel 80 during the actuating operation of lever 72, such as, for example, push stopper 54 which is always kept retreated from the range of movement of frame 52 by spring 541 and is advanced by a finger or the like against spring 541 as required into the range of movement of frame 52 to stop movement of frame 52. Thus, tape 20 can be fed without printing.

Furthermore, tape feeding means 40 is preferably provided with a tape stopping means which stops operation of the tape feeding means as required so that tape 20 is stopped during the resetting operation of lever 72. Thus, this means is advantageous in that the printing can be performed at the same position while tape 20 is kept stopped and therefore the symbols such as accents, apostrophe, dash, etc. can be added to the printed characters.

As this means, sliding piece 48 can be provided which is entered between teeth of ratchet wheel 44 by manual operation as shown in FIG. 9B to prevent engagement of feed claw 45 with ratchet wheel as required.

This sliding piece 48 is adapted to guide feed claw 45 so that feed claw 45 parts from the engaging position (shown with the broken line) of ratchet wheel 44 along sliding piece 48 and returns to the original engaging position *a* along sliding piece 48. Since feed claw 45 cannot be engaged at point *b* at which it will otherwise be engaged if sliding piece 48 is not provided, ratchet wheel 44 is stopped while sliding piece 48 is used.

When type wheel 80 is rotated while selecting the types in accordance with the read characters, notches 84 of type wheel 80 are engaged in sequence with projection 132 of type wheel holding part 13 and depressed by resilient depressing means 131, and type wheel 80 rotates while repeating the snapping to accurately position selected type 82' at printing position P, that is, the position where selected type 82' contacts to ink roller 62.

When lever 72 is moved toward handle 12 against spring 71 as shown in FIG. 13A to cause lever 72 to perform the actuating operation, first engaging part 652 provided on extended part 73 of lever 72 is engaged with first receiving part 653 provided on lever 46 of tape feeding means 40 to move lever 46, and ink roller 62 rolls to apply the ink to selected type 82' in accordance with movement of lever 46 retreats from the position in front of type wheel 80 into main body 11 as shown in FIG. 13B.

Lever 46 is reset to the home position by spring 651 as shown with the broken line in FIG. 13B when first engaging part 652 is released from first receiving part 653, subsequently applies the ink to type 82' when second engaging part 652' engages with second receiving part 653' and parts from type wheel 80 as shown in FIG. 13C. Accordingly, the ink is applied repeatedly to type 82' by operation of ink roller 62.

In this operation, rotor 731' of other extended part 73' moves along cam edge 522 provided on frame 52 and comes off from cam edge 522 when ink roller 62 finishes application of the ink, and frame 52 is forced by impression spring 53 to impress tape leading part 20' onto the printing position of type wheel 80, thereby paper tape 21 is impressed onto selected type 82' and printed.

When lever 72 is reset, frame 52 is forced away from type wheel 80 against impression spring 53 as shown in FIG. 13D, ink roller 62 is subsequently moved from the position shown with the solid line to the position shown with the broken line to be reset and feed claw 45 engages with ratchet wheel 44, thereby tape leading part 20' held by and between feed roller 41 and impression roller 43 is fed as specified.

When tape 20 is fed, a new surface of paper tape 21 is supplementarily fed to impression part 52' of frame 52 and other types are impressed in sequence by repeating the above-mentioned operation. Then this printed part 20'' is cut off by moving cutting edge 91 of cutting mechanism 90 against spring 92, covering tape 23 is peeled off from cut paper tape 21 and only the paper tape is adhered onto a desired article.

Referring to FIGS. 16 to 26, there is shown another embodiment. Tape impression means 50 is constructed to move type wheel 80 and case 10 is provided with tape receiving surface 15 as a tape extending part. Handle 12 is provided with sliding lever 72 which is designed to be held stationary by resetting spring 71. Type wheel holding part 13 has frame 133 projecting from main body 11 and arm 134 which is pivotally secured to frame 133 and extends its free end above tape receiving surface 15, and spring 55 which always deflects arm 134 toward tape receiving surface 15 is mounted on arm 134. Type wheel 80 is remountably secured at the arm 134 so that its periphery is opposed to tape receiving surface 15.

Tape receiving surface 15 is provided to extend tape leading part 20' and impression surface 15' opposed to type wheel 80 is provided with guide means such as, for example, parallel projected segments 151 and 151' which cause tape leading part 20' to be accurately opposed to type wheel 80, and tape turnback part 16 is provided at the free end.

Tape storing part 30 is formed by hollow case type tape holder 33 provided on the outside of case 10 and roll type tape 20 is rotatably stored in tape holder 33 and tape leading part 20' is pulled out through tape outlet port 331.

Tape impression means 50 comprises spring 55 and tye wheel separating mechanism 56 which always keeps type wheel 80 away from tape receiving surface 15.

Type wheel separating mechanism 56 is adapted to release type wheel 80 by the actuating operation of lever 72 and forces type wheel 80 away from tape receiving surface 15 by the resetting operation of lever 72.

Ink roller 62 is pivotally mounted on the free end of support member 61 which is provided with roller 561 which is coaxial with ink roller 62.

Type wheel 80 is remountably mounted on arm 134 with fixture 85 and guide member 562 is provided on the surface of type wheel 80 at the side of arm 134.

Guide member 562 comes in contact with roller 561 and has straight surface 563 and inclined surface 564 following straight surface 563. While roller 561 contacts straight surface 563, type wheel 80 is separated from tape receiving surface 15 against the force of spring 55 and, when roller 561 comes in contact with inclined surface 564, type wheel 80 is depressed by spring 55 onto tape leading part 20'.

Type wheel 80 is provided with an engaging means for snap operation which comprises notch 86 for each type 82 and ball 87 which is supported by spring 871 and fitted into notch 86.

Figure 16:
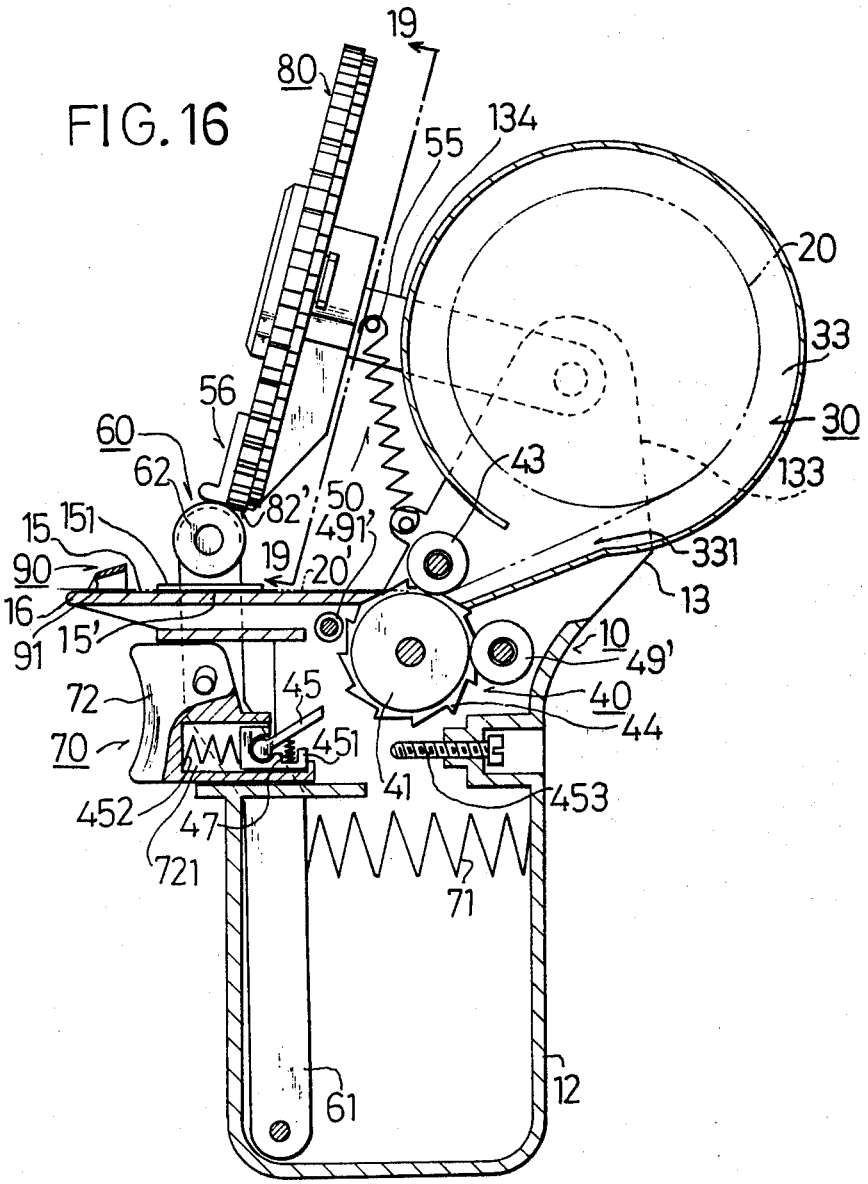
FIG. 16 is a longitudinal side view of principal parts illustrating the second embodiment of the tape printer.
Figure 17:
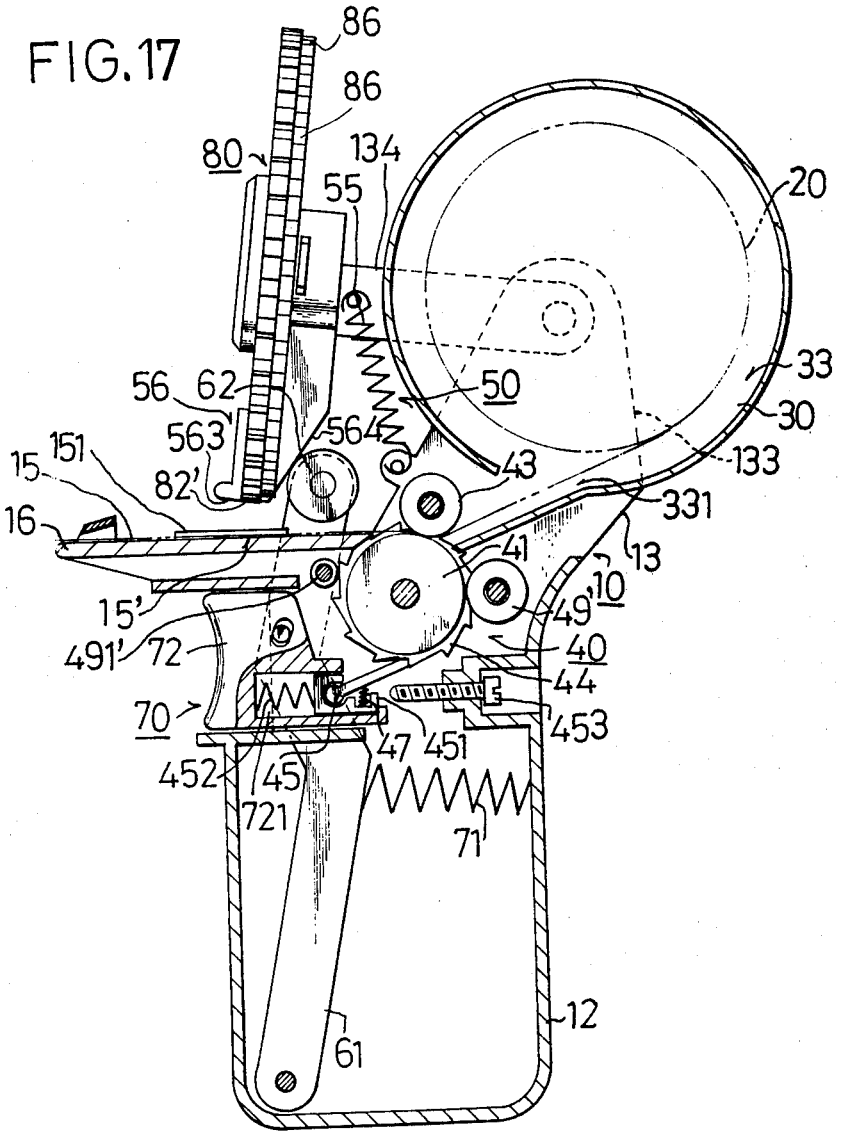
FIGS. 17 and 18 are a longitudinal side view of principal parts illustrating in steps the operations of the tape printer shown in FIG. 16.
Figure 18:
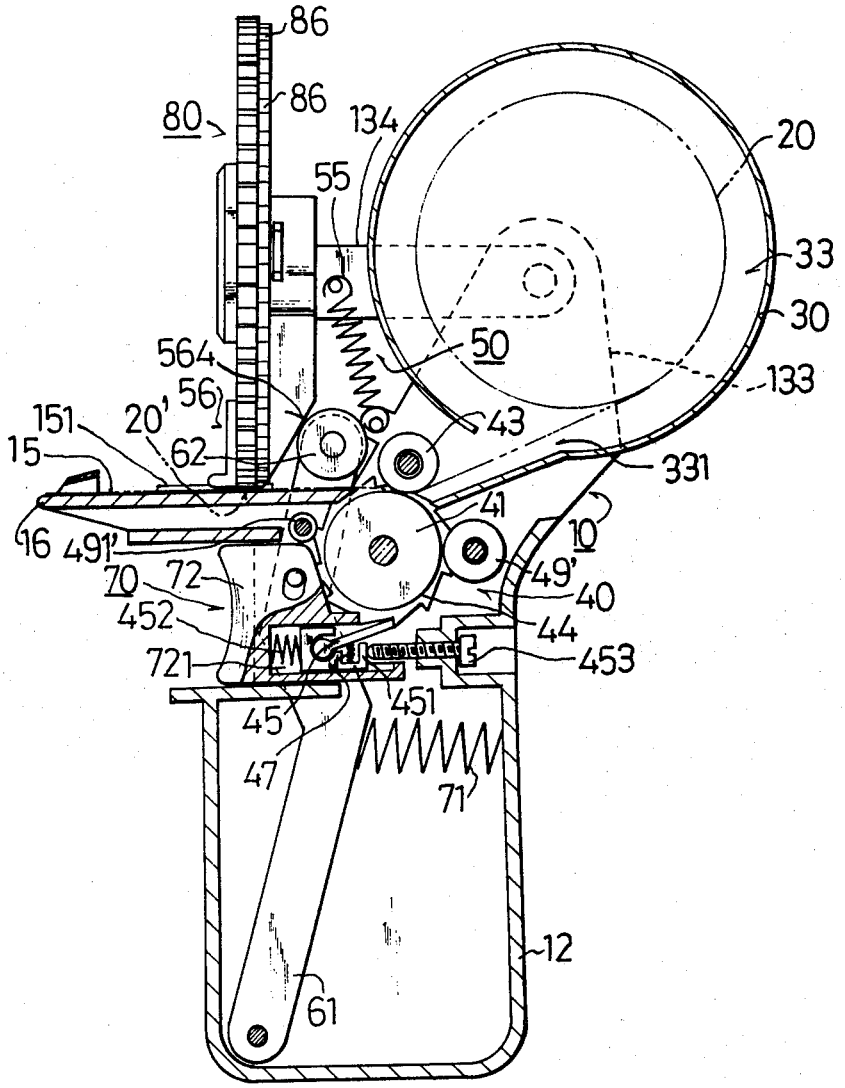

As shown in FIGS. 16 to 18, supporting member 61 of ink applying means 60 is pivotally secured to case 10 at its lower end and engaged with lever 72 at its body. When lever 72 is actuated against spring 71, ink roller 62 and roller 561 move clockwise in the figure and, when lever 72 is released, it is reset by spring 71.

In this embodiment, tape feeding means 40 comprises feed roller 41 and pressure roller 43 which hold tape leading part 20', ratchet wheel 44 pivotally mounted on feed roller 41 and feed claw 45 which is attached to sliding case 451 and can be engaged with ratchet wheel 44.

Sliding case 451 is slidably fitted into groove 721 provided in lever 72 and groove 721 is provided along the direction of movement of lever 72. Spring 452 which depresses sliding case 451 toward ratchet wheel 44 is provided in groove 721.

Feed claw 45 is pivotally secured to sliding case 451 and energized by spring 47 upwardly in the figure. Screw type stopper 454 is provided in the forward direction of sliding case 451 as a control means which controls the forwarding position of sliding case 451.

Tape feeding means 40 is provided with a tape turnback mechanism which turns back covering tape 23 at tape turnback part 16.

Figure 22:
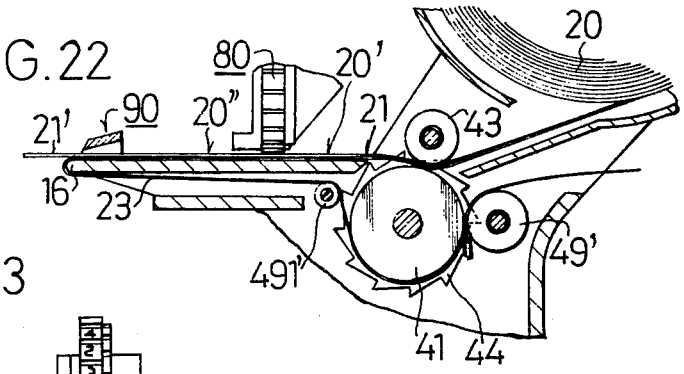

Said tape turnback mechanism pulls covering tape 23, and can comprise pullback pressure roller 49 which pressure-contacts feed roller 41 to pull back the tape and guide roller 491 as shown in FIG. 22.

Under the normal condition, support member 61 is kept at the extreme left position by resetting spring 71 as shown in FIG. 16 and ink roller 62 is positioned between type wheel 80 and tape receiving surface 15. At this time, straight surface 563 of guide member 562 is depressed onto roller 561 by spring 55 and feed claw 45 is kept at a position away from ratchet wheel 44.

When lever 72 is depressed, support member 61 is moved to the right as shown in FIG. 17. In the initial stage of movement of support member 61, roller 561 rotates while keeping contact with straight surface 563 of guide member 562 and, at the same time, ink roller 62 rotates while keeping contact with type 82 to apply the ink onto type 82' at the printing position.

When roller 561 comes off from straight surface 563 and comes in contact with inclined surface 564 of guide member 562, type wheel 80 approaches tape receiving surface 15 in accordance with increase of moving angle of support member 61.

When lever 72 is depressed, sliding case 451 moves to the right in the figure along with movement of lever 72 as shown in FIG. 17, thereby feed claw 45 engages with ratchet wheel 44 to cause feed roller 41 to rotate it.

When sliding case 451 comes in contact with stopper 453, sliding case 451 does not advance and therefore ratchet wheel 44 stops rotation. Thus sliding case 451 is set so that type wheel 80 does not come in contact with tape leading part 20' until sliding case 451 comes in contact with said stopper 453.

When lever 72 is depressed, support member 61 moves while depressing spring 452 as shown in FIG. 18 and type wheel 80 is depressed onto tape leading part 20' and type 82' impresses paper tape 21 under the condition that tape 20 is stopped.

When lever 72 is released from depression, support member 61 is reset by resetting spring 71 and, ink roller 62 and roller 561 move to the left in the figure and type wheel 80 is reset along with the resetting of roller 561.

Figure 21:
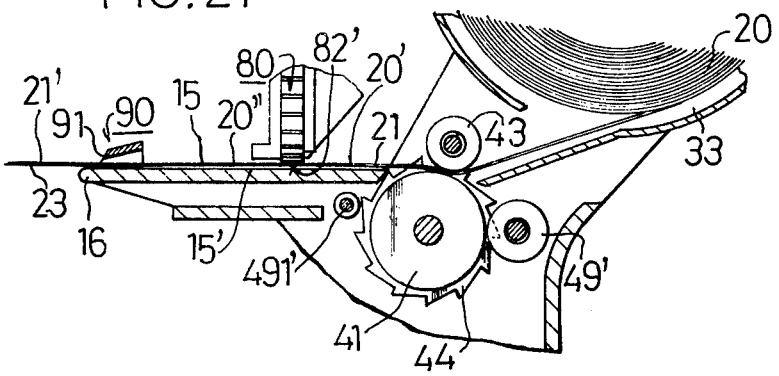

Tape 20 can be forwarded without being pulled back at tape turnback part 16 as shown in FIG. 21 or covering tape 23 of tape leading part 20' can be turned back at tape turnback part 16 as shown in FIG. 22.

In case of latter, only paper tape 21' can be fed out while peeling off from covering tape 23.

Figure 23:
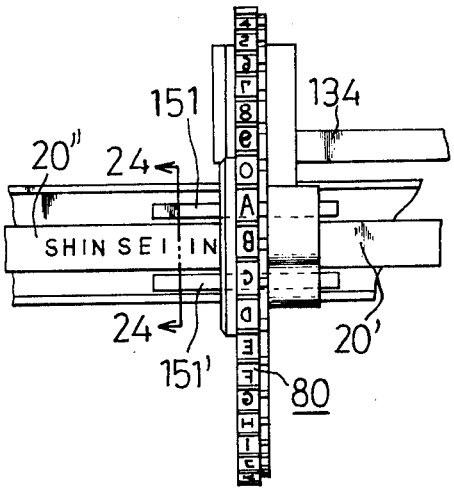
FIG. 23 is a plan view of the tape receiving surface.

If stopper 453 is of a screw type, the stroke of sliding case 451 and the feed length of the tape 20 can be adjusted. The guide means of tape receiving surface 15 can be formed, as shown in FIG. 23, by a pair of projected segments 151 and 151' provided along both edges of tape leading part 20' in the widthwise direction or as shown in FIG. 25 by frame 152 through which tape leading part 20' is passed. In this case, frame 152 is preferably deviated from the printing position toward the tape holder. Cutting mechanism 90 is provided at tape receiving part 15 to cut printed part 20'' so that the cutting position can be seen from outside. Cutting mechanism 90 can be adapted so that depression piece 94 is provided opposing to cutting edge 91 at a position where depression piece 94 comes in contact with the rear surface of printed part 20''.

Figure 19:
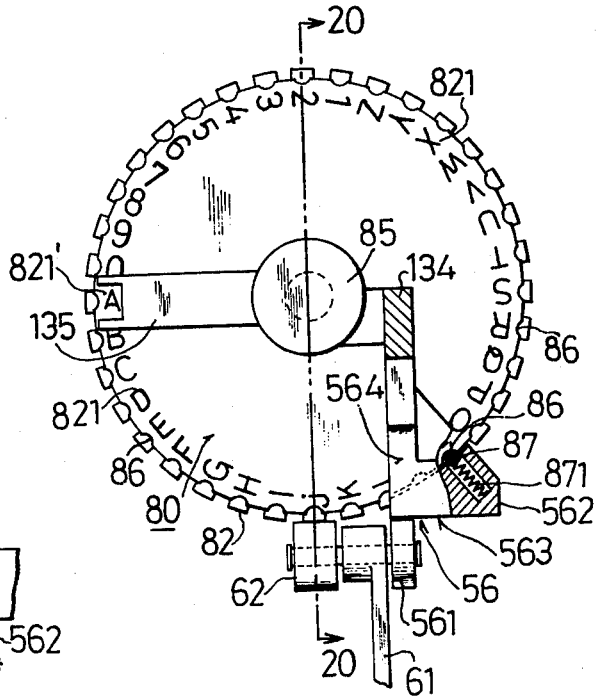
FIG. 19 is a cutaway rear view along line 19—19 in FIG. 16.
Figure 20:
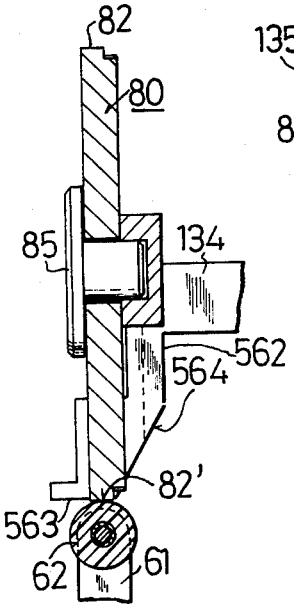
FIG. 20 is a sectional view along line 20—20 in FIG. 19, FIGS. 21 and 22 are a side view illustrating an example of use of the tape feeding mechanism of the second embodiment.

Type wheel 80 is preferably inscribed with read characters 821 as shown in FIG. 19. In this case, read character 821 being read is preferably indicated by, for example, indicator 135.

Type wheel 80 can be used in a combination of a plurality of type wheels arranged in parallel.

In both the above two embodiments type wheel 80 is provided with types 82 on its circumferential periphery, and type wheel 80 of the present invention can be provided with types 82 on its side periphery.

Referring to FIGS. 27 to 32, the tape printer of this embodiment is provided with handle 12 in the lower part of case 10. This handle 12 incorporates tape storing part 30, and tape feeding means 40 and tape impression means 50 are provided in main body 11.

Cover plate 14 of L-shaped section mounted on the back of handle 12 is shown which is used to set tape 20 in tape storing part 30.

Figure 27:
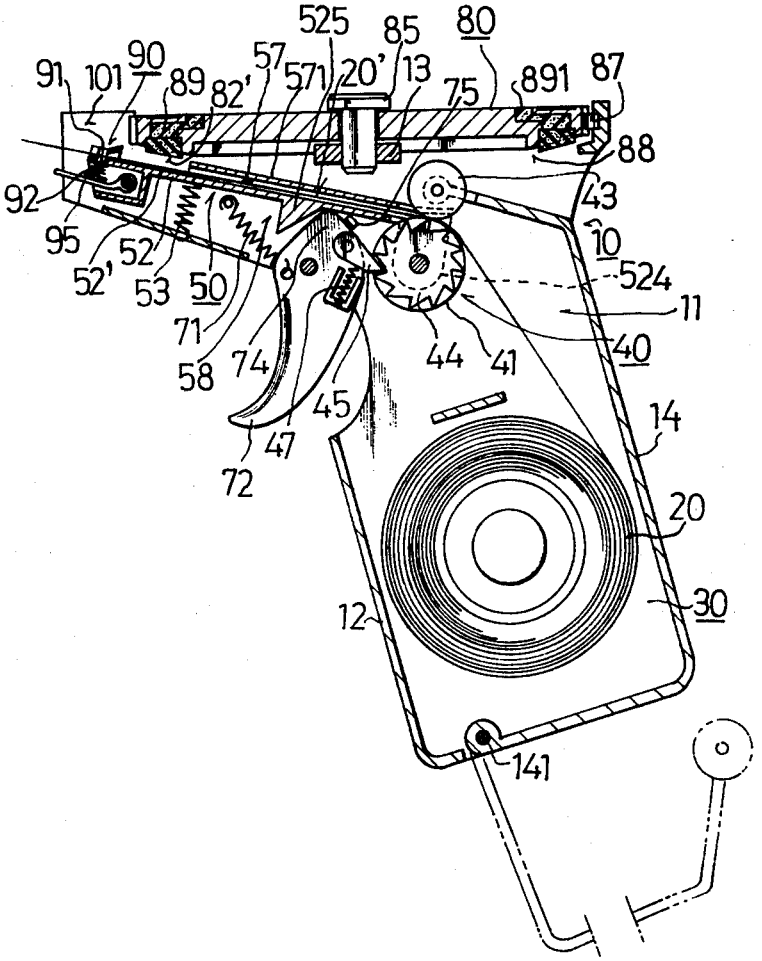
FIG. 27 is a longitudinal side view illustrating the third embodiment of the tape printer in accordance with the present invention.

Cover plate 14 is pivotally mounted on handle 12 by dowel pin 141 and turns to form the tape storing port as shown with a two-dotted broken line in FIG. 27.

Tape feeding means 40 has feed roller 41 with which ratchet wheel 44 is coaxially mounted and pressure roller 43 which comes in pressure-contact with feed roller 41.

Though pressure roller 43 can be pivotally secured at main body 11, it is preferably to secure pivotally pressure roller 43 at the free end of cover plate 14.

Such arrangement is convenient to set tape leading part 20' on tape impression means 50 and tape feeding means 40.

Ratchet wheel 44 is engaged with and rotated by feed claw 45 and feed claw 45 is pivotally secured at internal end 74 of lever 72.

Feed claw 45 is provided with spring 47 of which one end is secured at lever 72 and the free end of feed claw 45 is forced to come in pressure contact with ratchet wheel 44. When lever 72 is depressed to move, feed claw 45 moves to engage with the above adjacent tooth of wheel 44. When lever 72 is released at that position, feed claw 45 rotates ratchet wheel 44 by a certain fixed angle and feed roller 41 rotates to feed the tape as much as specified in the direction toward tape impression means 50 since lever 72 is reset to a position of stopper 75.

Tape impression means 50 has moving frame 52 provided with guide tunnel 57 and spring 53 which maintains frame 52 away from type wheel 80. Upper wall 571 of guide tunnel 57 is partly cut off at the printing position so that tape leading part 20' is exposed.

Type wheel 80 is provided with flange 88 at its lower periphery and types 82 are provided in sequence on flange 88. Type wheel 80 is rotatably mounted on type wheel holding part 13 with fixture 85 so that selected type 82' may be moved to the printing position.

Type wheel 80 can be made by arranging individual units of types 82 in an annular position as shown in FIG. 30A or made as an annular unit on which types 82 are molded as shown in FIG. 30B.

Types 82 are attached with the ink reservoir such as, for example, ink-soaked part 89 made by soaking a sponge with ink. Ink-soaked part 89 is provided behind type 82 to supply the ink to the type. Ink-soaked part 89 is preferably provided continuously in an annular form as shown in FIG. 28 to uniformly supply the ink to all types 82.

The upper surface of type wheel 80 can be provided with a suitable number of ink supply ports 891 through which the ink is supplied to ink-soaked part 89. One ink-soaked part 89 can be provided for a plurality of types 82 or for each type 82.

Types 82 absorb the ink supplied from ink-soaked part 89 and are made of a porous material so that the printing surfaces of the types are always kept wet.

Though a porously foamed plastic material or sintered metal can be used as porous material, it is preferably to use a porous rubber.

Read characters 821 corresponding to types 82 are inscribed on the upper surface of type wheel 80. Engaged parts 86 are provided as the concavity on the external periphery of type wheel 80 and engaging parts 87 which engage with engaged part 86 are provided on case 10, and type wheel 80 is snap-actuated by these members.

Actuating means 58 is provided which causes type 82' to be impressed onto tape leading part 20' by making type wheel 80 and frame 52 relatively contact and separate from each other. Though actuating means 58 can be constructed as desired, it can be adapted, for example, as shown in FIG. 27. Type wheel 80 is pivotally secured to type wheel holding part 13 through fixture 85.

Type wheel holding part 13 is horizontally projected from the internal wall of main body 11. Therefore, type wheel 80 is not rocked vertically. Frame 52 is provided so that it contacts and separates from type 82'. Frame 52 is mounted coaxially with feed roller 41 with mounting piece 524 provided projectedly at one end of frame 52 and moving end 74 of lever 72 comes in contact with the lower surface of frame 52.

Projection 525 which comes in contact with end 74 of lever 72 is provided at the lower surface of frame 52 and, when lever 72 is actuated, this projection 525 is pushed up to cause tape impression part 52' to come in pressure contact with type 82' as shown in FIG. 29.

Hereupon, type wheel 80 can be made as a movable type as shown in FIG. 32. Tape leading part 20' is extended on tape receiving surface 15 of the case.

Type wheel 80 is adapted to contact and separate from impression surface 15' of tape receiving surface 15. Support shaft 801 which moves down type wheel 80 is provided and support beam 802 is pivotally secured to support shaft 801. Support beam 802 pivotally supports type wheel 80 through fixture 85 and one end of support beam 802 is connected to lever 72 by connecting rod 803 so that type wheel 80 may be moved down around support shaft 801 by movement of lever 72.

When lever 72 is actuated, support beam 802 moves counterclockwise to cause type wheel 80 to lower and contact tape leading part 20', thus performing the impression for printing. When lever 72 is released, all members are reset to respective home positions by spring 71.

Case 10 is provided with tape outlet port 101 from which tape printed part 20'' is fed out and cutting mechanism 90 which cuts tape printed part 20'' in a desired length as shown in FIG. 27.

Cutting edge 91 which is energized downward by spring 92 is provided to orthogonally intersect tape printed part 20'' and cutting lever 95 to vertically move cutting edge 91. When cutting lever 95 is pushed up, tape printed part 20'' is cut off from tape leading part 20' by cutting edge 91.

In this embodiment, the tape printer is characterized with that type wheel 80 is opposed in parallel to tape leading part 20', types 82 are provided on the peripheral surface of type wheel 80, and ink applying means 60 having ink roller 62 is not required since the ink is supplied from ink-soaked part 89 to types 82.

Type wheel 80 of the present invention can be adapted so that types 82 may be independently depressed onto tape leading part 20'.

Referring to FIGS. 33 to 38, there is shown case 10 forming handle 12 and provided with tape outlet port 101. In case 10, tape storing part 30 which stores rolled tape 20 and tape receiving surface 15 which guides tape 20 from tape storing part 30 to tape outlet port 101 are provided.

Tape receiving surface 15 is formed by and between a pair of guide plates 153 and 153' and guide wall 153 of the upper surface is notched at its impression surface 15'.

Type wheel 80 is provided opposing to the impression surface 151 and is made to be a disk type as a whole. A number of notches 811 are provided on base plate 81 from its periphery to the center thereby a plurality of type segments 812 are formed.

Each type segment 812 is made up by forming type face 813 which is inclined by a small angle and, for example, projected type 82 on type face 813.

Figure 37:
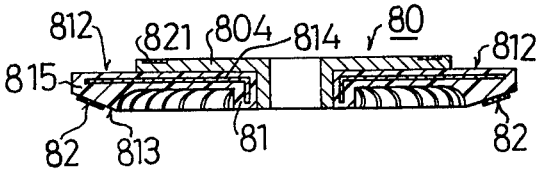
FIG. 37 is a cross sectional view of the type wheel useful in the fourth embodiment.
Figure 38:
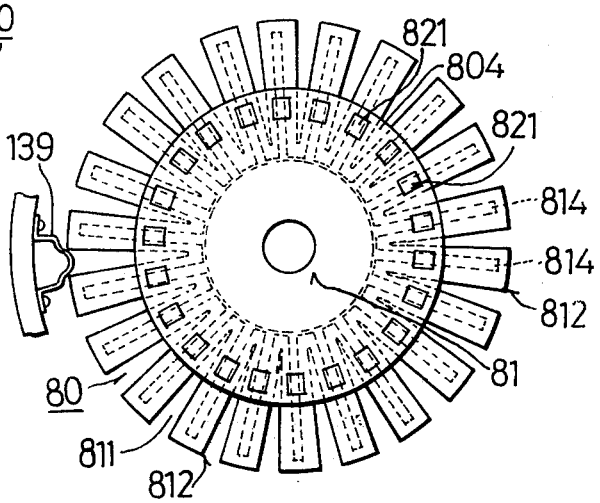
FIG. 38 is a plan view of the type wheel.

Type wheel 80 can be made so that each type segment 812 may be individually flexible and may recover to its original form for the resilience of material and may be made by spring plate 814 and rubber cover sheet 815 as shown in FIG. 37.

Index plate 804 is provided overlapped on type wheel 80 and read characters 821 corresponding to types 82 are entered on index plate 804.

Figure 34:
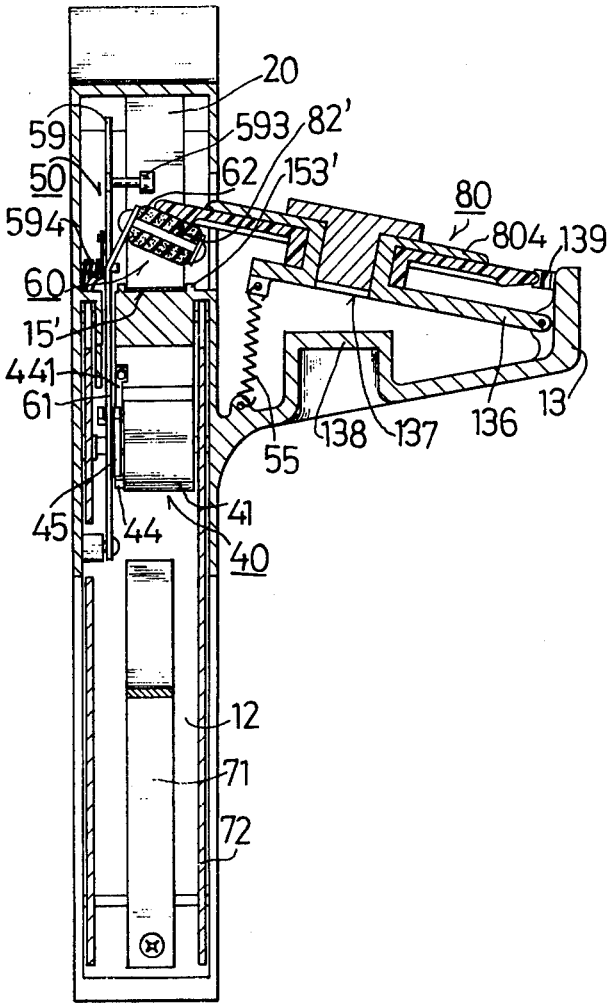
FIG. 34 is a longitudinal side view along line 34—34 in FIG. 33.

Type wheel 80 can be made so that type 82' to be printed is positioned to oppose said printing position and can be supported so that type 82' may contact and separates from impression surface 15'. For example, support arm 136 is provided at type wheel holding part 13 as shown in FIG. 34, and one end of support arm 136 is pivotally secured to case 10 and the other end is provided with fitting part 136 which fits into the center of type wheel 80 so that type wheel 80 can be manually rotated in the circumferential direction in which types 82 are arranged in sequence.

Support arm 136 is provided with tension spring 55 similar to spring 55 shown in FIG. 16 to give to type wheel 80 a force in the direction that type 82' to be impressed is always forced to approach impression surface 15' and spacer 138 which maintains the specified clearance between impressed type 82' and tape leading part 20'.

Accordingly, type wheel 80 is kept at the position where support arm 136 is forced to contact with spacer 138 by the force of tension spring 55 when type wheel 80 is not pushed up by ink roller 62 and, at this position, impressed type 82' approaches tape leading part 20' but does not contact tape reading part 20'.

For type wheel 80, engaging piece 139 made of a resilient material is provided opposing to type wheel 80 and adapted to engage with notch 811.

Engaging piece 139 is adapted to stop type wheel 20 at the position where each type segment 812 comes to oppose to impression surface 15'.

Lever 72 provided with case 10 is pivotally secured to main body 11 of case 10 at its one end and the other end is made as a free end close to which resetting spring 71 is provided.

Lever 72 actuates ink roller 62 which applies the ink to type 82', tape feeding means 40 and a type actuating means such as, for example, type actuating arm 59 which impresses type segment 812' at the printing position.

Ink roller 62 is rotatably mounted on the moving end of support member 61 of which other end is pivotally secured to main body 11.

Ink roller 62 is adapted to move along with movement of support member 61, from a position where ink roller 62 comes in contact with type 82' and applies the ink to type 82' to a position where ink roller 62 escapes through type wheel 80 and impression surface 15'.

The body of lever 72 is provided with impression roller 722 which comes in contact with support member 61.

When lever 72 ismoved clockwise, impression roller 722 depresses support member 61 to cause support member 61 to move counterclockwise in the figure and ink roller 62 to rotate from a position where it contacts type 82' to the left in the figure.

Feed claw 45 is pivotally secured to support member 61 and is engaged with ratchet wheel 44.

Feed roller 41 is coaxially fixed with ratchet wheel 44 and pressure roller 43 is forced to contact feed roller 41.

Feed claw 45 is adapted to rotate ratchet wheel 44 clockwise in the figure to feed tape 20 when support member 61 is moved to the left by the specified angle from the home position and to disengage from ratchet wheel 44 to stop feeding of tape 20 when the moving angle of support member 61 exceeds the specified angle.

Reverse rotation check claw 441 which prevents ratchet wheel 44 from counterclockwise rotation is provided for ratchet wheel 44.

Type actuating arm 59 is provided to depress type segment 812' from above to deflect type segment 812' toward impression surface 15'.

Type actuating arm 59 is made in the U shape and one bent part is pivotally secured by support shaft 591 to main body 11, and bearing roller 592 which contacts member 61 is provided at one end and operating roller 593 located above type segment 812' is provided at the other end. Type actuating arm 59 is provided with spring 594 which gives the resilient resetting force in the direction where bearing roller 592 is forced in pressure contact with support member 61.

When support member 61 is moved counterclockwise, type actuating arm 59 is moved clockwise due to depression by support member 61 to cause operating roller 593 to lower onto type segment 812' from the above thereby type segment 812' is depressed to impress type 82' onto tape leading part 20'.

Support member 61 is provided with resetting spring 613 so that it moves clockwise in the figure to reset when support member 61 is released from the depressing force of lever 72.

Resetting spring 613 always depresses support member 61 to be pressure contact with depression roller 722.

Cutting mechanism 90 has cutting lever 95 pivotally secured near tape outlet port 101 and depressing surface 96 formed on this cutting lever 95, and cutting edge 91 is projected at a position opposing to depressing surface 96.

When cutting lever 95 is turned clockwise in the figure, tape printed part 20'' is depressed to cutting edge 91 by depressing surface 96 to be cut.

Under a normal condition that a gripping force is not applied to lever 72, ink roller 62 is positioned below type wheel 80 and feed claw 45 is engaged with ratchet wheel 44.

When lever 72 is turned clockwise in the figure, support member 61 is depressed by depression roller 722 to turn counterclockwise and ink roller 62 contacts types 82' to apply the ink during its rotation.

When lever 72 is further turned, ink roller 62 gradually lowers and type wheel 80 is moved to approach impression surface 15' by tension spring 55.

Feed claw 45 advances to the left in the figure, ratchet wheel 44 is rotated to cause feed roller 41 and pressure roller 43 to feed tape 20, type actuating arm 59 is turned and operating roller 593 is lowered toward type wheel 80.

Figure 35:
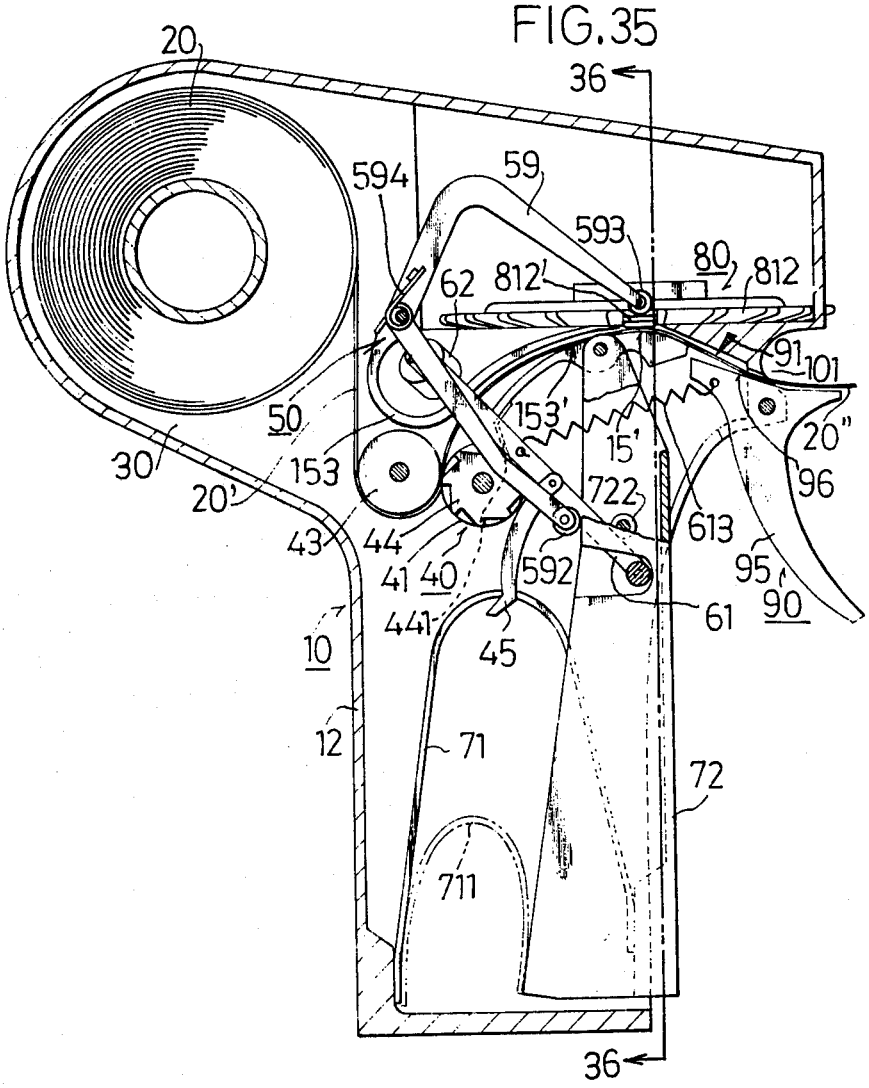
FIG. 35 is a longitudinal partial side view illustrating the operating condition of said tape printer.

When lever 72 swings exceeding angle $\theta$, feed claw 45 is disengaged from ratchet wheel 44 as shown in FIG. 35 and the feeding of tape 20 is stopped. However, ink roller 62 continues turning until it comes off from type wheel 80 and type wheel 80 lowers to come in contact with receiving member 138.

Figure 36:
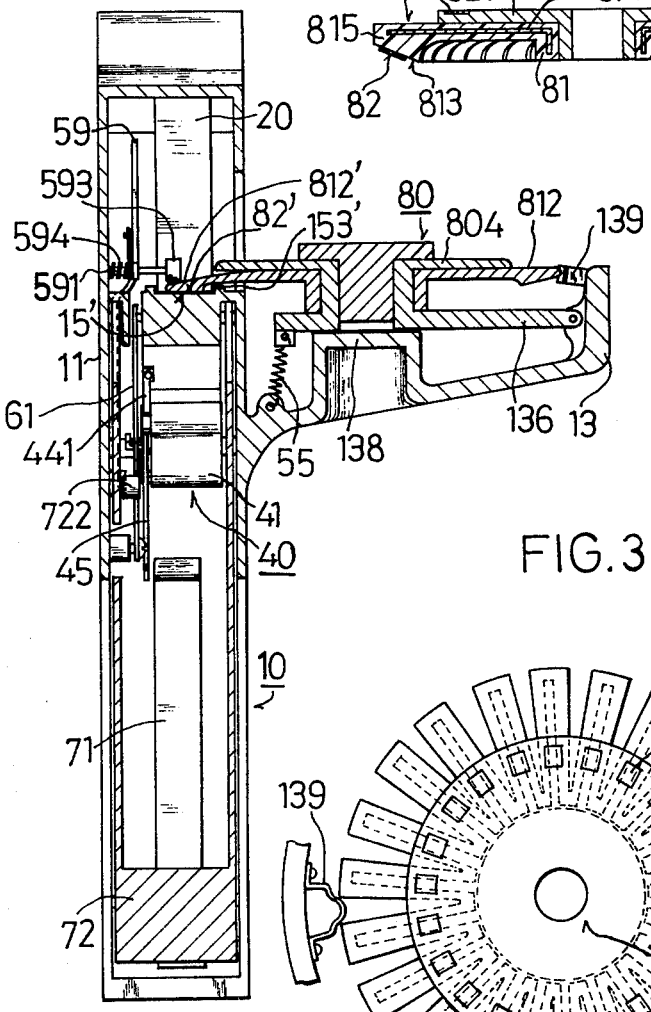
FIG. 36 is a longitudinal side view along line 36—36 in FIG. 35.

Operating roller 93 comes in contact with type segment 812' from above as shown in FIG. 36 to depress type segment 812' to make type 82' contact with tape leading part 20' on impression surface 15', thus carrying out the printing on tape 20.

Figure 33:
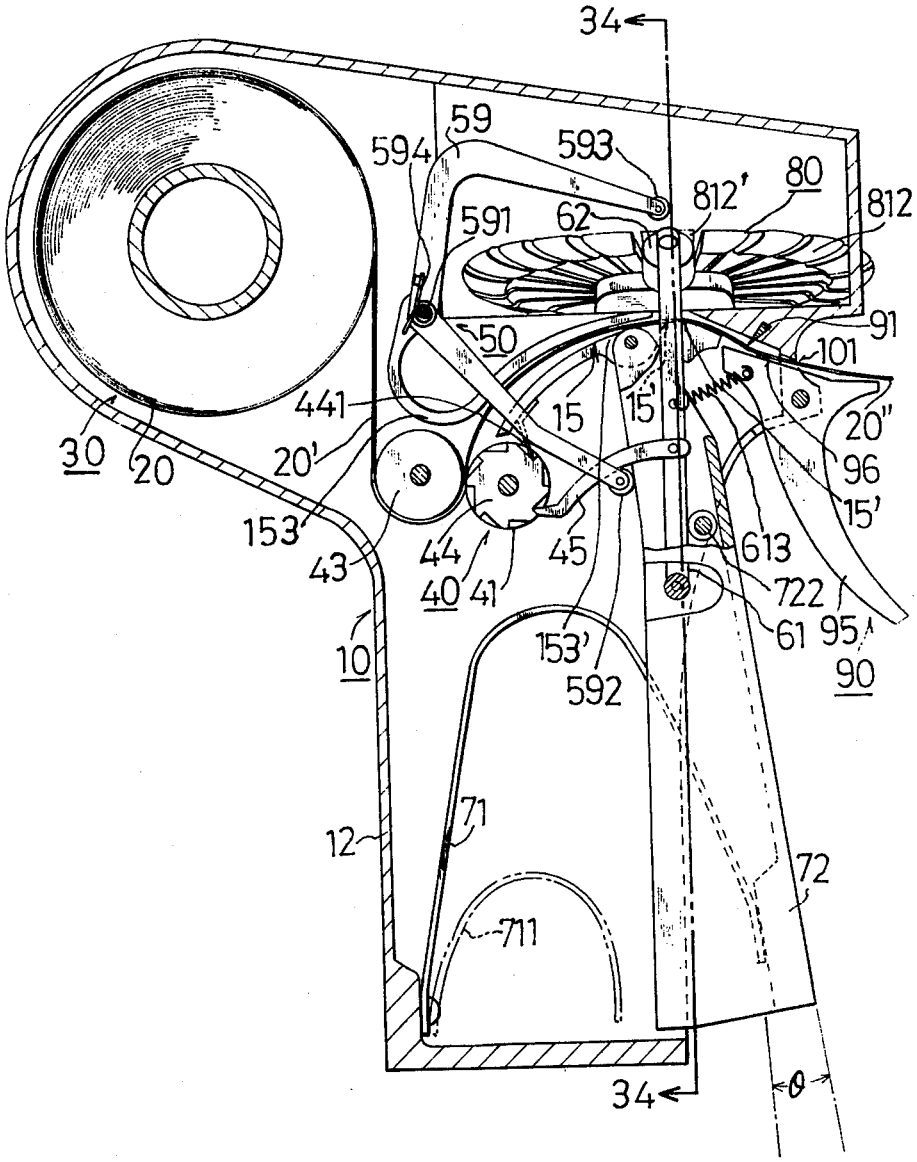
FIG. 33 is a longitudinal partial side view illustrating the fourth embodiment of the tape printer.

When lever 72 is released, all components are reset to the positions shown in FIGS. 33 and 34 by the resetting means.

For selection of the characters and symbols to be printed, type wheel 80 can be manually rotated.

When lever 72 is turned and reset in the range of the specified angle up to $\theta$, only the feeding of tape 20 can be performed without printing. Accordingly, non-printing feed can be performed.

Lever 72 is preferably made so that a force required to turn lever 72 increases suddenly when lever 72 is turned exceeding angle $\theta$. For example, auxiliary spring 711 which gives the resetting force to lever 72 when lever 72 is turned to angle $\theta$ as shown with a phantom line in the figure can be provided. When lever 72 is turned, the resetting force of spring 71 alone acts up to angle $\theta$ and the resetting forces of auxiliary spring 711 and spring 71 act when lever 72 exceeds angle $\theta$; accordingly, the range of non-printing feed can be definitely recognized by the feeling of fingers and therefore it is easy to avoid erroneous printing when only non-printing feed is required.

In the first and second embodiments, type 82' used for impression is preferably projected from the external periphery to the radial direction. As in the fourth embodiment, type segment 812' is preferably sufficiently projected from the peripheral surface in the direction of thickness of type wheel 80.

FIGS. 39 to 43 show type wheel 80 useful in the first and second embodiments.

Figure 39:
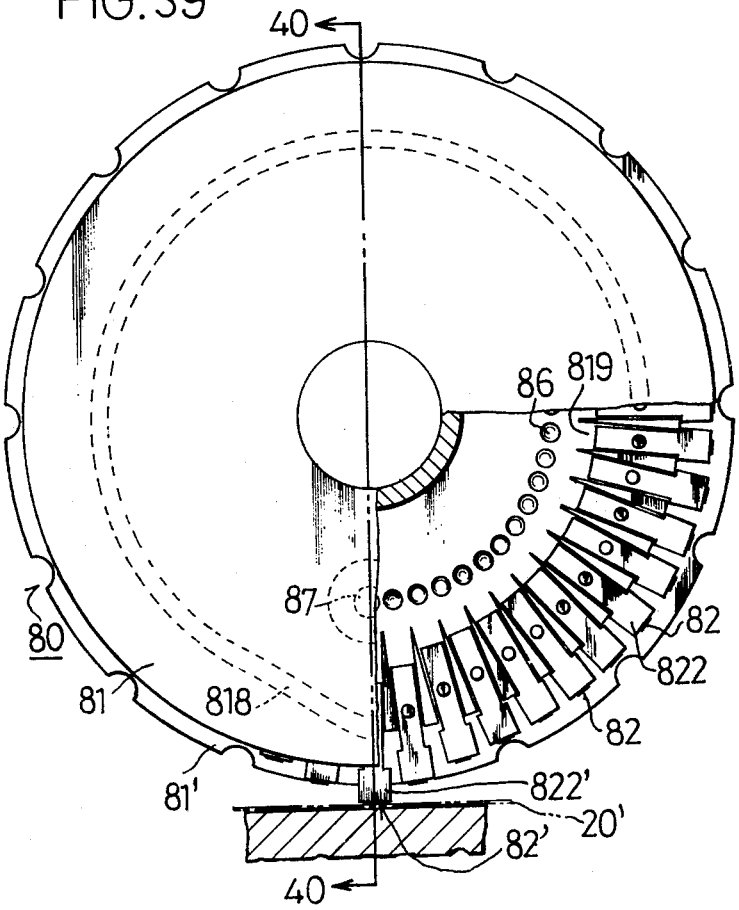
FIG. 39 is a cutaway front view illustrating another embodiment of the type wheel.
Figure 42:
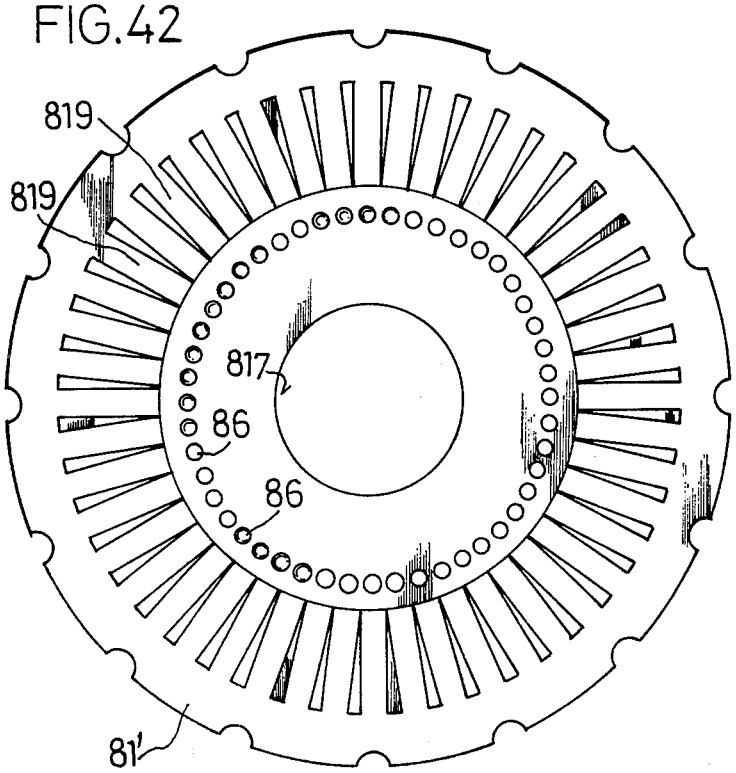
FIG. 42 is a front view of the rotary plate of said type wheel.

In FIG. 39, type wheel comprises base plate 81 which cannot be rotated and rotary disk 81' which is provided in parallel with base plate 81.

As shown in FIG. 40, base plate 81 has shaft core 816 projected at the center and is mounted on case 10 by fixing shaft core 816 to type wheel holding section 13.

Rotary disk 81' is provided with shaft hole 817 at the center and mounted on shaft core 816 of base plate 81 through shaft hole 817 to be rotatable.

Figure 43:
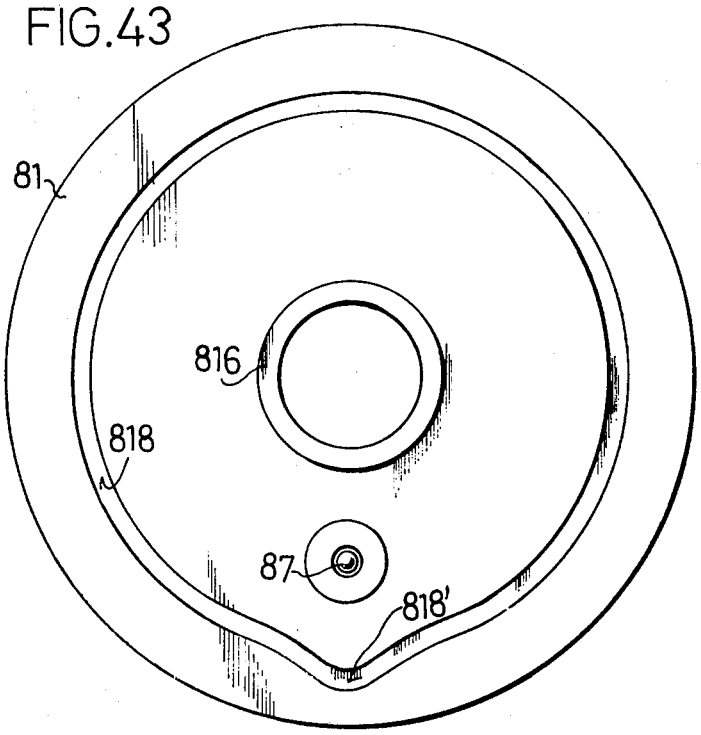
FIG. 43 is a rear view of the base of said type wheel.

Base plate 81 is provided with a guide means such as, for example, guide groove 818 at the internal surface opposed to the rotary disk and this guide groove 818 is made in an annular shape which is partly expanded toward the periphery as shown in FIG. 43, and expanded part 818 is positioned to oppose to tape leading part 20'.

Base plate 81 and rotary disk 81' are provided with the positioning means which controls the stopping position of rotary disk 81'.

Said positioning means can be adapted so that rotary disk 81' is stopped at every specified rotation angle and performs snap operation, and a stopping means, for example, shown in FIG. 19 can be used.

In other words, concaved hole 872 is provided in base plate 81 (or rotary disk 81'), spring 871 is inserted into hole 872 and, at the same time, stopper 87 which is always projected by spring 871 is provided. Rotary disk 81' (or base plate 81) is provided with engaging holes 86 which are arranged with a fixed distance on the circumference with shaft hole 817 as the center and the stopping position of rotary disk 81' is determined at every specified rotation angle by engagement of stopper 87 with engaging hole 86.

The internal surface of rotary disk 81' is provided a number of slots 819 which oppose to and intersect orthogonally guide groove 818 and sliding elements 822 are inserted into slots 819 respectively. Slots 819 are arranged so that sliding elements 822 is opposed to tape leading part 20' when rotary disk 81' stops after snap operation. Said positioning means is provided to correctly oppose sliding element 822 to tape leading part 20'.

Sliding element 822 is adapted to slide along and in slot 819, that is, in the radial direction of rotary disk 81' and to be guided by projection 8221 which comes into guide groove 818.

Accordingly, sliding elements 822 reach in sequence expanded part 818' of guide groove 818 in accordance with rotation of rotary disk 81' and only sliding element 822' which has reached expanded part 818' is projected outside from the periphery of rotary disk 81' as shown in FIG. 39.

Type 82 are provided for each sliding element 822.

Accordingly, since type 82' which contacts tape leading part 20' projects outside from the periphery of rotary disk 81', other adjacent types can be completely prevented from contacting tape leading part 20' even though the distance between the types is small.

Figure 44:
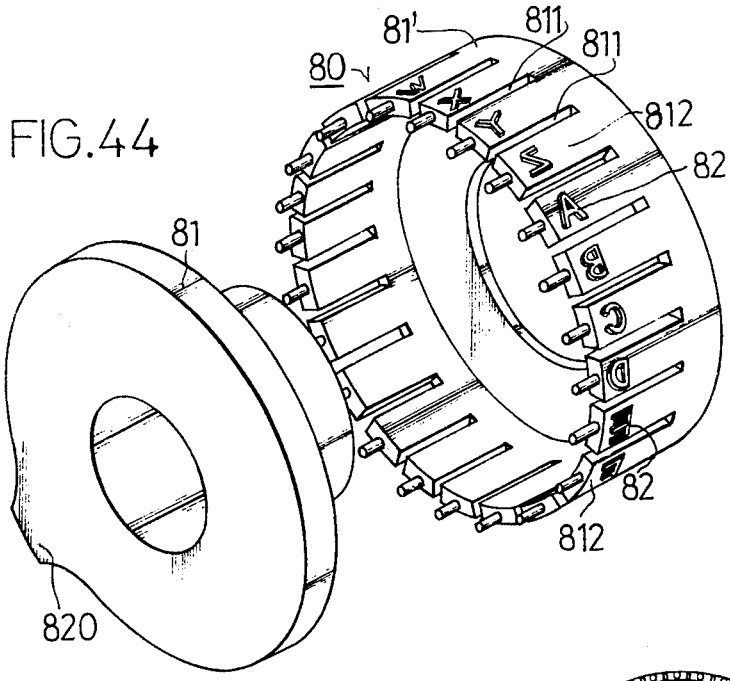
FIG. 44 is a disassembled perspective view illustrating another embodiment of the type wheel.
Figure 45:
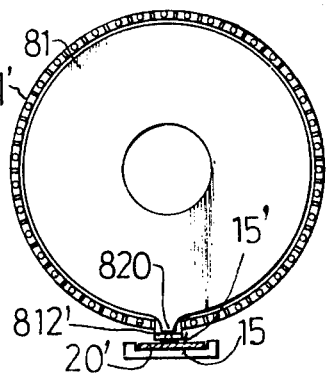
FIG. 45 is a front view of the type wheel shown in FIG. 44.

Referring to FIGS. 44 and 45, type wheel 80 is constructed such that projection 820 which projects in the radial direction from the periphery of base plate 81 is provided at base plate 81, base plate 81 is fixed by opposing projection 820 to tape leading part 20' on impression surface 15', rotary disk 81' is externally mounted on base plate 81 and provided with the peripheral wall which is closely opposed to the outer periphery of base plate 81, a number of notches are provided in said peripheral wall to form a number of type segments 812 and each type 82 is provided with type segment 812. Type segment 812' to be used for printing is moved to outside projection 820 to project only the type segment for printing outside type wheel 80 by projection 820.

Figure 46:
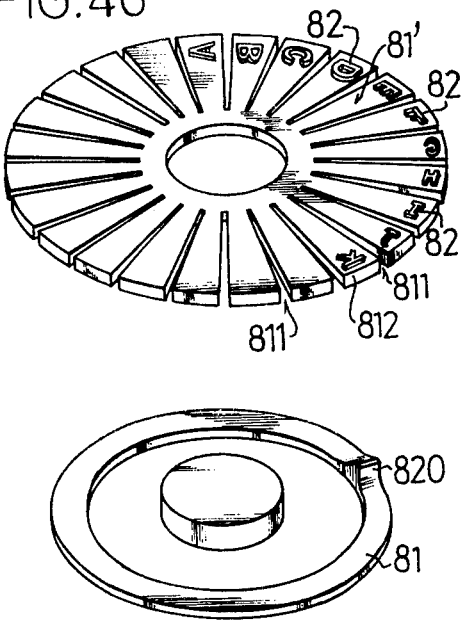
FIG. 46 is a disassembled perspective view illustrating another embodiment of the type wheel.
Figure 47:
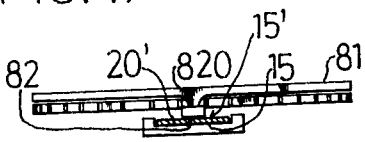
FIG. 47 is a front view of the type wheel shown in FIG. 46.

Type wheel 80 shown in FIGS. 46 and 47 is used in the tape printer shown in FIG. 33. A number of notches 811 is provided on rotary disk 81' to form a number of type segments 812 and each type 82 is provided with type segment 812. Projection 820 is provided to be located at the edge of base plate 81 and is arranged to oppose to impression surface 15'. Thus, type segment 812' used for impression is moved to the outer surface of projection 820 to project type segment 812' in the direction of thickness of the type wheel.

The type wheels shown in FIGS. 44 and 47 provide the same effects as the type wheel shown in FIG. 39.

The tape printer of the present invention is not restricted to the embodiments described above, and another embodiment can be made by combining parts of these embodiments and a modification of the embodiment is possible. For example, the tape impression means, ink applying means and tape feeding means can operate with one operation of the operating means. Ink application and impression of the tape need not always be performed by the actuating operation of the operating means and feeding of the tape by the resetting operation of the operating means. Even though this relationship of the operations is reverse or in the actuating operation or the resetting operation, all operations from ink application to feeding of the tape can be finished.

What is claimed is:

1. A tape printer comprising a. a tape storing section which stores a roll of tape, b. a tape extending part which extends a tape leading part pulled out from said tape storing section, c. a guide means provided on said tape extending part to prevent said tape leading part from moving in a widthwise direction, d. a type wheel provided with a plurality of types on its periphery in a circumferential direction, e. a type wheel holding part which holds said type wheel to be rotatable in the circumferential direction so that one of the types on said type wheel is opposed to the tape of said tape leading part on said tape extending part and a type opposed to said tape can be selected, f. a tape impression means which relatively impresses a selected type of said type wheel and the tape of said tape leading part opposed to said selected type, g. an ink applying means which applies an ink for printing to a surface of type of said type wheel opposed at least to said tape leading part in precedence of operation of said tape impression means, h. a tape feeding means which operates except during operation of said tape impression means and feeds the tape as much as specified at each time of operation, and i. an operating means which operates said ink applying means, said tape feeding means and said tape impression means at each time of operation.

2. A tape printer in accordance with claim 1, wherein said tape comprises a paper tape, an adhesive layer formed with an adhesive agent on a rear surface of said paper tape and a cover tape made of a material which can be adhered onto and easily peeled off from said adhesive layer.

3. A tape printer in accordance with claim 1, wherein said guide means comprises guide slots which are provided at both sides of said tape extending part and are made so that both edges of said tape leading part are inserted therein.

4. A tape printer in accordance with claim 1, wherein said guide means comprises a tunnel type frame into which the tape leading part on said tape extending part is inserted.

5. A tape printer in accordance with claim 1, wherein a plurality of types are arranged on the external periphery of said type wheel along its circumferential direction.

6. A tape printer in accordance with claim 5, wherein an annular type strip provided with a plurality of types in the circumferential direction is secured closely to a periphery of a base of said type wheel.

7. A tape printer in accordance with claim 5, wherein said type wheel comprises the base at a fixing side and a rotary disk which is coaxially provided with said base to be rotatable, an annular guide slot which is projected toward the periphery at a printing position being provided on an internal surface of said base, slits which orthogonally intersect said guide slot being provided for all types on said rotary disk and sliding pieces incorporated in said slits, said sliding pieces being provided with projections which come in said guide slot, a type is provided on the external surface of each sliding piece and a type of said sliding piece being adapted to project from the periphery of said type wheel at said printing position.

8. A tape printer in accordance with claim 5, wherein said type wheel comprises the base at the fixing side and the rotary disk which rotates over said base, said rotary disk being provided with a peripheral wall in which said base is mounted in to oppose to said peripheral wall, a plurality of type segments separated by notches formed on the peripheral wall, a type being provided on said each type segment, a part of said base corresponding to the printing position being projected toward the tape extending surface to form a projection and said type wheel being adapted so that the selected type is moved to the printing position by rotating said rotary disk and said selected type is forced to project outside by said projection.

9. A tape printer in accordance with claim 1, wherein said types are provided on the peripheral surface of the type wheel along the circumferential direction of the type wheel.

10. A tape printer in accordance with claim 1, wherein a plurality of radial type segments are provided on said type wheel, a type is provided on the top of each type segment and only a type segment at the printing position of said type segments is bent to impress said tape leading part.

11. A tape printer in accordance with claim 10, wherein radial type segments are provided on a rotary disk and a fixed base is provided with a projection at the printing position so that the type segment selected by rotation of said rotary disk is bent by said projection at the printing position.

12. A tape printer in accordance with claim 1, wherein said tape impression means comprises a movable frame which moves the tape to said type wheel at the fixed position.

13. A tape printer in accordance with claim 1, wherein said tape impression means is adapted to move said type wheel to the tape on a tape extending surface at the fixed position.

14. A tape printer in accordance with claim 1, wherein an ink applying means has an ink roller which is actuated by every operation of an operating means to apply the ink onto a tape at the printing position.

15. A tape printer in accordance with claim 14, wherein said ink applying means is provided with an inking repeating mechanism so that the ink roller is actuated to apply the ink at least two times onto a type at the printing position at each operation of said operating means.

16. A tape printer comprising (a) a casing with a handle attached thereto, (b) a tape storing section contained in said handle which stores a roll of tape, (c) a tape extending part which extends a tape leading part pulled out from said tape storing section, (d) a guide means provided on said tape extending part to prevent said tape leading part from moving in a widthwise direction, (e) a type wheel provided with a plurality of types on its periphery in a circumferential direction, (f) a type wheel holding part which holds said type wheel to be rotatable in the circumferential direction so that one of the types on said type wheel is opposed to the tape of said tape leading part on said tape extending part and a type opposed to said tape can be selected, (g) a tape impression means disposed in said casing which relatively impresses a selected type of said type wheel and the tape of said tape leading part opposed to said selected type, (h) an ink applying means disposed in said casing also which applies an ink for printing to a surface of type of said type wheel opposed at least to said tape leading part in precedence of operation of said tape impression means, (i) a tape feeding means also disposed in said casing which operates except during operation of said tape impression means and feeds the tape as much as specified at each time of operation, and (j) an operating means which operates said ink applying means, said tape feeding means and said tape impression means at each time of operation.

* * * * *